US005697736A

United States Patent [19]

Veazey et al.

[11] Patent Number: 5,697,736

[45] Date of Patent: Dec. 16, 1997

[54] SEAWALLS AND SHORELINE REINFORCEMENT SYSTEMS

[75] Inventors: Sidney E. Veazey, King George; Charles R. Riley, Midland, both of Va.

[73] Assignee: Custom Precast Concrete, L.L.C., King George, Va.

[21] Appl. No.: 285,052

[22] Filed: Aug. 3, 1994

[51] Int. Cl.[6] ..... E02D 29/02

[52] U.S. Cl. ..... 405/284; 405/21

[58] Field of Search ..... 405/284, 18–21, 405/28–31, 218

[56] References Cited

U.S. PATENT DOCUMENTS

| | | | |
|---|---|---|---|
| 1,173,879 | 2/1916 | Shearer . | |
| 1,229,152 | 6/1917 | Shearer . | |
| 1,247,750 | 11/1917 | Upson | 405/218 |
| 1,489,428 | 4/1924 | Cushing | 405/21 |
| 1,847,043 | 2/1932 | Ball | 405/30 |
| 2,159,685 | 5/1939 | Buzzell | 405/20 |
| 3,344,609 | 10/1967 | Greiser | 405/20 X |
| 3,722,222 | 3/1973 | Rinkel | 405/16 |
| 3,802,205 | 4/1974 | Dickinson | 405/21 X |
| 3,957,098 | 5/1976 | Hepworth et al. | 405/19 X |
| 4,152,875 | 5/1979 | Soland | 405/19 X |
| 4,165,197 | 8/1979 | Postma | 405/218 |
| 4,375,928 | 3/1983 | Crow et al. | 405/20 |
| 4,440,527 | 4/1984 | Vidal | 405/284 |
| 4,607,985 | 8/1986 | Matsushita | 405/284 |
| 4,643,618 | 2/1987 | Hilfiker et al. | 405/284 X |
| 4,911,585 | 3/1990 | Vidal et al. | 405/284 X |
| 4,914,876 | 4/1990 | Forsberg | 52/169 |
| 4,940,364 | 7/1990 | Dlugosz | 405/19 X |
| 5,087,150 | 2/1992 | McCreary | 405/31 |
| 5,158,395 | 10/1992 | Holmberg | 405/21 |
| 5,178,493 | 1/1993 | Vidal et al. | 405/284 |

OTHER PUBLICATIONS

*New 1992 CRSI Handbook*, pp. 14–8 to 14–12 and 14–20/21. (Concrete Reinforcing Steel Institute, Schaumburg, IL).

"Concrete–Block Design Has Inner Strength", Form & Function, by John Pierson, *The Wall Street Journal*, Dec. 13, 1993, p. B1.

"Precast Protection Mat", by Bill Blaha (*Concrete Products*, date unknown).

"Burned by Warming–Big losses from violent storms make insurers take global climate change seriously", by Eugene Linden p. 79, *TIME*, Mar. 14, 1994.

*Low Cost Shore Protection . . . a Property Owner's Guide*, U.S. Army Corps of Engineers–1981, pp. 1–159.

*Low Cost Shore Protection . . . a Guide for Engineers & Contractors*, U.S. Army Corps of Engineers–1981, pp. 1–173.

*Primary Examiner*—Dennis L. Taylor

*Attorney, Agent, or Firm*—James K. Poole

[57] ABSTRACT

Systems for reinforcing various waterfront properties such as riverbanks, lake shores and beaches of oceans, bays and the like to protect them from erosion and encourage accretion of beach sand and gravel are disclosed. Improved seawalls and the like can be built from L-shaped members having a vertical wall portion, a horizontal footer, a vertical key protruding below the footer and an angular splash plate protruding from the wall opposite the footer. Systems based upon such seawalls may further comprise groins perpendicular thereto which are built from inverted "T"-shaped members, and optionally rows of such inverted "T" members parallel to the seawall as well. Further, erosion of the bank above the seawall and/or the beach below same may be reduced by partially covering them with water-permeable concrete mats. One or more groins extending perpendicular from the seawall may preferably be fabricated of inverted "Double T" members and adapted to support a pier. Various embodiments of floating piers are disclosed, including some with hydraulic self-driving piles. Systems for the reinforcement and protection of sand dunes or other soil formations can incorporate rows of inverted "T" members approximately parallel to and perpendicular to the shoreline, together with sections of concrete mats covering portions of the areas between same.

18 Claims, 10 Drawing Sheets

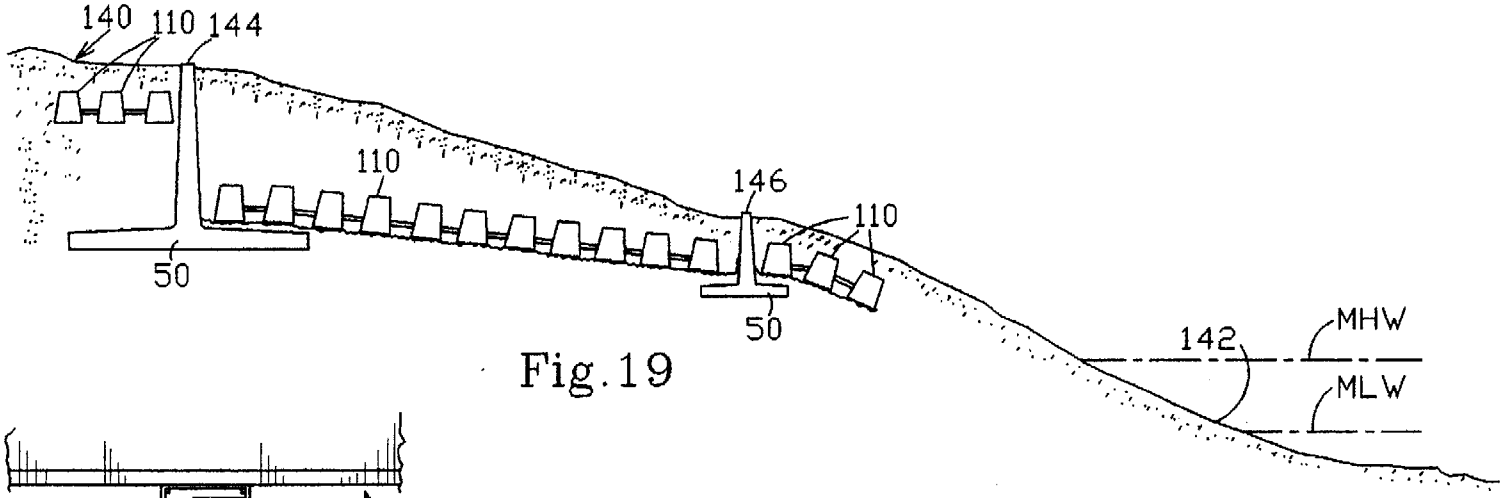
Fig.19
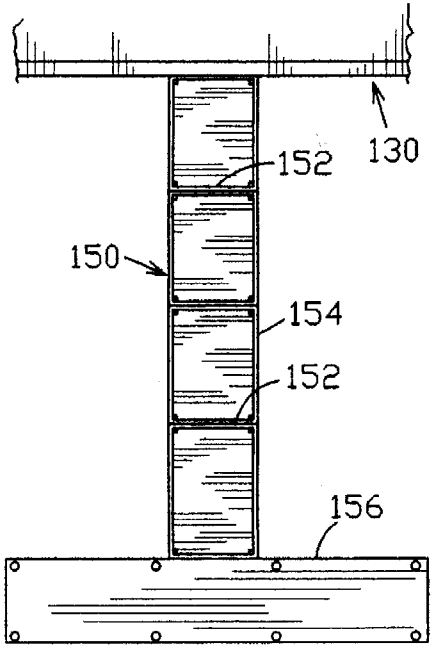
Fig.20
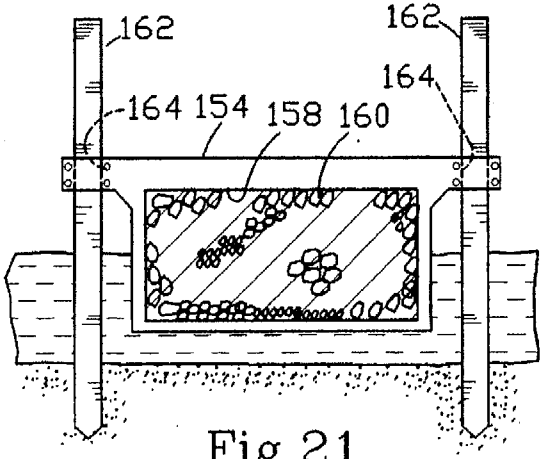
Fig.21
Fig.22
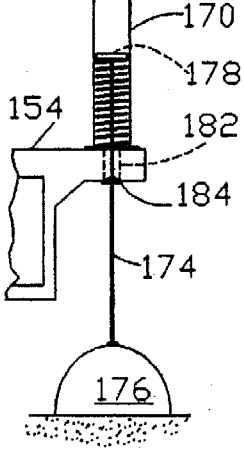
Fig.23

SEAWALLS AND SHORELINE REINFORCEMENT SYSTEMS

BACKGROUND OF THE INVENTION

This application pertains to seawalls and various reinforcement systems for limiting shoreline erosion by rivers, lakes, oceans, sounds and other major bodies of water.

Mankind has gravitated to the water-land interface or littoral areas along lakes, rivers, bays, sounds and oceans for residential, commercial and recreational purposes. To further these purposes, many fixed shoreline structures have been built at considerable effort and cost. However, Nature constantly, albeit generally slowly, changes these shorelines through erosion, storms, and even earthquakes. Recent statistics and studies indicate that increasing amounts of damage are occurring yearly to salt water shoreline areas in particular due to higher tidal levels and storms of increasing severity. According to Eugene Linden, "Burned by Warming", *TIME*, Mar. 14, 1994 (pg. 79), such problems can be expected to intensify in the near future. Among the erosion problems encountered are the gradual or rapid direct erosion of bluffs or slightly elevated shorelines, loss of sand and pebbles from beach surfaces, destruction of piers, boathouses and other protruding or exposed artificial structures, and the washing away of sand dunes along the shoreline. In many barrier island areas such as Long Island, New York and in the Carolinas, barrier islands have been eroded to the extent that dune systems are destroyed, new inlets and channels are formed for the ocean and adjacent waterways, and buildings, roads and other manmade structures are destroyed and/or swept away.

For centuries efforts have been made to reinforce shoreline areas to prevent erosion and retain desirable waterfront sites for use. The ultimate in these efforts is represented by the shoreline reclamation projects in the Netherlands, where the sea is pumped out and kept out by dikes so that larger areas can be farmed or otherwise used by man. However, for residential or recreational use of littoral areas, typically smaller seawalls or bulkheads have been built to reinforce land areas at or above high tide areas. Many materials and structures are used, but almost all experience problems with erosion at the foot and edges of the walls as well as more severe damage during storms. Moreover, the addition of walls or other structures to the shoreline often results in changes in the pattern of sand and pebble build up, in some cases leading to "sandless beaches".

Various structural elements are used in typical engineering practice to build such seawalls and the like. See, e.g., the *CRSI Handbook*, published by the Concrete Reinforcing Steel Institute of Schaumburg, Ill., and *Low Cost Shore Protection* (U.S. Army Corps of Engineers), both of which are incorporated herein by reference.

SUMMARY OF THE INVENTION

An object of the present invention is to provide improved components and systems for reinforcing shoreline areas along the various oceans, sounds, bays, lakes and rivers to preserve desirable real estate for its highest and best uses. A further object is to provide enhanced residential and recreational use of shoreline areas, with structures for movement over and use of the water/land interface. Another object is to retain suitable areas of sand deposits, dunes and beaches while minimizing loss or damage by erosion or storm. An ultimate object of the invention is to provide integrated systems of shoreline reinforcements and improvements tailored to local conditions and environments to limit erosion, provide for buildup and retention of dune and beach sand where appropriate and provide residential and recreational facilities without undue damage to the shoreline.

All these objects and more are provided by use of the various embodiments of the present invention. In accordance with the invention, structural elements are provided which have the shape of a modified letter "L" (See FIG. 1), comprising a vertical wall portion, a horizontal footer, a vertical key protruding below the footer and an angular splash plate protruding from the wall opposite the footer. When used to form a seawall or bulkhead, these L-units are installed with the splash plates facing the water. The splash plate provides at least a minimal angular surface (i.e., forming an obtuse angle with the wall above and an acute angle from the horizontal) against which waves may impact and dissipate their energy. The length and angle of this splash plate can be varied to suit soil and environmental conditions, and should be designed to be seated sufficiently deep in the beach immediately adjacent to the wall to resist scour and erosion under the wall.

Such units can be used at the foot of bluffs, elevated shoreline areas, sand dunes or the like to build solid seawalls or bulkheads, as described herein. They can be installed by entrenching, filling in the open portion of the "L" with earth, sand, gravel or the like, and/or can be anchored by "geotubes," shown in FIGS. 12/13 and described below.

In addition to basic seawalls or bulkheads, integrated systems for shoreline protection can be built by emplacing inverted "T" structures in various patterns in combination with the walls. Such T structures, shown in FIG. 7, can resemble commercially available highway safety barriers or similar precast shapes, but preferably have broader "feet". They can be emplaced parallel to the wall and shoreline, and/or used to form groins extending perpendicular or at acute angles from the shoreline. They are installed by positioning, ballasting with sand, gravel or the like on both "feet" and interconnection by cementing, mechanical connection or any other suitable connecting means. Preferably the feet of these structures are also secured to the bottom by pins, stakes or other suitable securing means.

Foundations for pier structures which form portions of the shoreline reinforcement systems of the invention can comprise such inverted "T" structures, inverted "Double T" structures as shown in FIG. 11, precast concrete boxes as shown in FIG. 15A, or combinations thereof. The concrete boxes used are preferably perforated and/or slotted to serve as wave degeneration cells.

Another embodiment of the invention provides floating pier installations comprising precast concrete pier sections comprising at least one buoyancy chamber and positioning means to control the lateral and vertical movement of the pier sections in the water during tidal movements and wave action. The buoyancy chambers are preferably at least partially filled with buoyant material. The positioning means can comprise a plurality of pilings, with apertures and/or restraining means in the pier sections to align the pilings with the pier sections. Suitable positioning means can also comprise a plurality of anchors, connecting means between the anchors and the pier sections, and tension control means incorporating springs and/or counterweights to maintain tension in the connection means, thus controlling the position of the pier sections.

The pilings used to support the piers or other components of the shoreline reinforcement systems of the invention can be self-driving pilings. A system for self-driving pilings comprises pilings which comprise a central longitudinal channel terminating in a nozzle at the pointed lower end thereof, fluid pumping means and fittings to permit the pumping of fluids under pressure through the channels to erode the bottom in which the piles are to be driven. Restraining and securing means can be used to position the pier temporarily in an elevated position above the water surface (as at high tide) so that its total weight bears upon the pilings to be driven. Pumping fluid through the channels of the pilings while such weight bears upon the pilings will cause them to settle into position. The self-driving pilings can be improved by adding a load-bearing cap to protect the concrete piling and the fittings for fluid connection, thus allowing more weight and/or tamping blows to be applied to the top. The operation of the self-driving piling system can be improved by applying vibratory forces to the piling while the fluids are being pumped through the piling channels, preferably also applying a downward force or weight to the pilings simultaneously.

Another component which can be used to form the systems of the present invention is a flexible ramp or revetment assembly comprising at least one layer of strong, flexible water-permeable fabric with individual precast concrete ramp sections permanently attached thereto. As illustrated in FIG. 16, such assemblies typically take the form of a long strip of water-permeable fabric with oblong sections of concrete arranged perpendicular to the strip. Such assemblies can be used to form temporary ramps for boats and/or vehicles, but can also be used to form reinforcing systems for beach or dune areas.

An integrated shoreline reinforcement system may comprise a linear array of "L" units installed at the foot of an elevated shoreline area and/or within a sand dune system, and further at least one linear array of "T" units substantially parallel to the shoreline. The "L" unit wall can be reinforced on the shore side by filling with sand, gravel or the like, and/or geotubes to anchor the shore-side footers of the "L" units. Such a system may further comprise at least one linear array of "T" units installed substantially perpendicular to the shoreline, connecting with the wall of "L" units and reinforcing the beach surface adjacent thereto. Further, flexible ramp assemblies can be laid along the beach or dune areas adjacent to the seawall, on the shore and/or seaward sides. Once installed, these assemblies can be reinforced by overlaying further assemblies of fabric and concrete components, preferably in interlocking fashion, or can be allowed to naturally fill with sand, gravel and flotsam.

Further in accordance with the invention, structures serving as breakwaters and/or portions of the shoreline reinforcement systems can be assembled of linear arrays of precast concrete boxes, preferably having sides which are perforated and/or slotted to allow the boxes to act as wave degeneration cells. Such rectangular boxes can be stacked and fastened together in various configurations to produce breakwater walls of the desired thickness and height, and can be filled with various solid materials to weight them into position.

Other objects and advantages of the present invention will become apparent from perusal of the following detailed description, drawings and the appended claims.

BRIEF DESCRIPTION OF THE DRAWINGS

FIG. 19 illustrates in cross-section a dune protection system.

FIGS. 20 through 25 illustrate a floating pier assembly including a floatable pier component made of concrete-encased styrofoam.

DETAILED DESCRIPTION OF THE INVENTION

Figure 4:
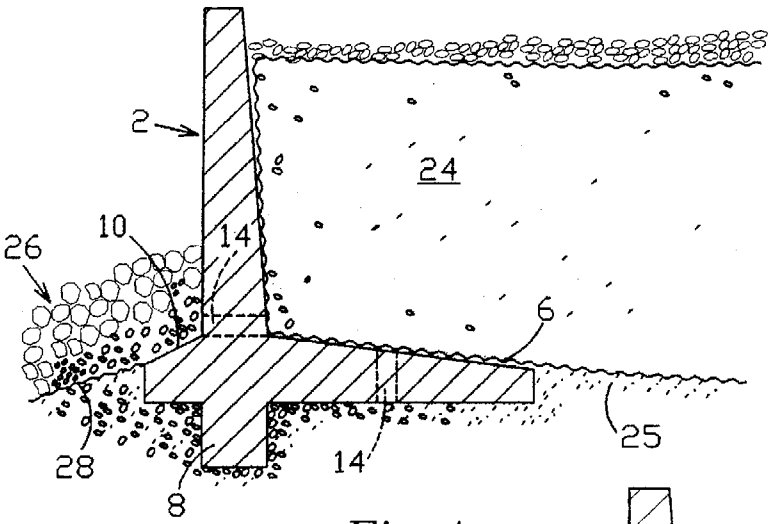
FIGS. 1 through 4 illustrate L-shaped wall units of the invention in cross section.

Because these littoral area discussed above are environmentally sensitive, products and structures used to control or impede Nature's destructive effects should be long-lasting, flexible, and inert or harmless to the environment. The precast concrete components discussed below have been found to meet these requirements. For example, debris from storm-damaged wooden seawalls can be hazardous to navigation, while the concrete structures used for erosion control as described herein are very durable and do not float.

The reinforcing systems of the present invention can be used in a variety of environments to control erosion by wind and wave, e.g. the beaches of oceans, bays and sounds, riverbanks, lakefronts and the like. In addition to controlling erosion in sand dune systems under extreme weather conditions, the dune protection systems disclosed herein can also be useful in soil formations which are vulnerable to mudslides or other unstable behavior, such as in hillside developments and graded highway rights-of-way.

Despite the wide applicability of the systems of the invention, for simplicity and clarity their installations will be discussed in terminology applicable to salt water beaches subject to tidal action. For example, in coastal areas, the tidal range runs from mean low water to the mean high water mark. Just above mean high water mark is the crest of the berm which forms the portion of the beach or shore known as the backshore, while the foreshore lies along the slope of this berm between mean low and high water marks. Where sand dune systems exist, they lie behind the beach or shore.

Due to seasonal tide and weather conditions, most beach areas go through annual cycles of erosion and accretion, with the areas lost to erosion in one season in a given area sometimes restored through accretion in later seasons. Most beaches are shaped by such normal action of waves and tides. However, major storms, bringing higher tides and severe action of waves and tides, can extend damage beyond the coastal berm to the dune systems, radically altering the form and structure of the dunes as well as the beach and in some cases even cutting new sea channels through barrier island structures.

Discussions herein will refer to "seaward" and "shoreward" as referring to directions generally toward and away from the adjacent body of water, whether ocean, river or lake. Filling eroded beach areas with sand or gravel provides repairs which may be only temporary if the normal patterns of erosion and accretion are not altered by installing, e.g., breakwaters and/or groins adjacent to the beach. A more permanent solution can be the so-called "perched beach", in which systems of low-lying retaining walls and groins are installed on the beach to catch and retain sand.

Bulkheads and seawalls protect waterfront banks and bluffs by completely separating land from water. Although their materials and construction techniques are similar, bulkheads usually act primarily as retaining walls for the soil formations behind them, while seawalls are primarily used to resist wave action. When either type structure is used in locations where there is significant wave action, steps must be taken to protect the beach areas immediately adjacent to the walls and the bank areas behind, where large waves may impinge. Breakwaters are used to seaward of seawalls, piers and other waterfront structures to attenuate waves before they reach such structures. The expression "and/or" is used in the usual sense to include either or both of the alternatives.

Figure 1:
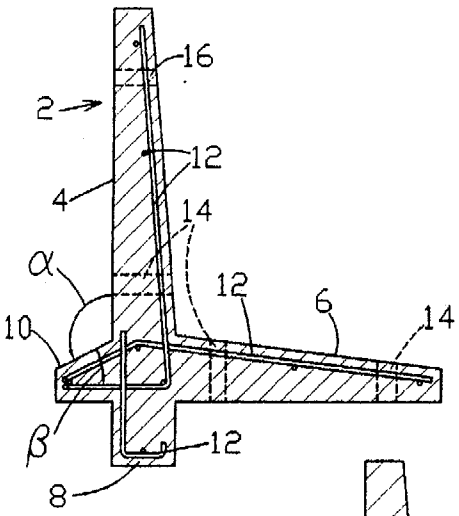

Turning now to the drawings, FIG. 1 illustrates an L-shaped structural member (2) in accordance with the invention, intended for use in retaining walls, seawalls and the like. Vertical wall or stem portion (4) is substantially perpendicular to footer (6), and vertical key (8) extends below the lower surface of the footer, essentially in line with the vertical wall portion. Angular splash plate (10) protrudes from wall (4) opposite footer (6), forming an obtuse angle ($\alpha$) downward from the wall and forming an acute angle ($\beta$) with the plane of the footer base. The thicknesses of the vertical wall and footer portions can vary, being thickest near their intersection where stresses are greatest and tapering toward their extremities. For optimum strength, such structural members are cast with metal reinforcing bars (rebars) (12) emplaced vertically and horizontally as shown to increase the strength of the member in operation. Holes (14) are preferably formed in the vertical wall and footer portions to provide drainage for liquid collecting behind the retaining wall or seawall. Holes (16) can also be placed to facilitate handling and interconnection of the L-members.

The L-shaped members and other components disclosed herein can be precast by conventional methods known in the art, and in some cases existing commercial components can be utilized to assemble the novel shoreline reinforcement systems of the invention. When the components are to be exposed to salt water, it is preferred that all rebar be at least about 2 inches from any surface of the cast bodies. Fiber reinforcement should be included in the concrete for strength, a relatively high proportion of Portland cement should be used in the mix, and the forms should permit a smooth finish to be obtained on the finished molded objects. The forms should be subjected to vibration, using commercially available mechanisms, after the molds are filled to consolidate the concrete and minimize voids or defects.

Figure 3:
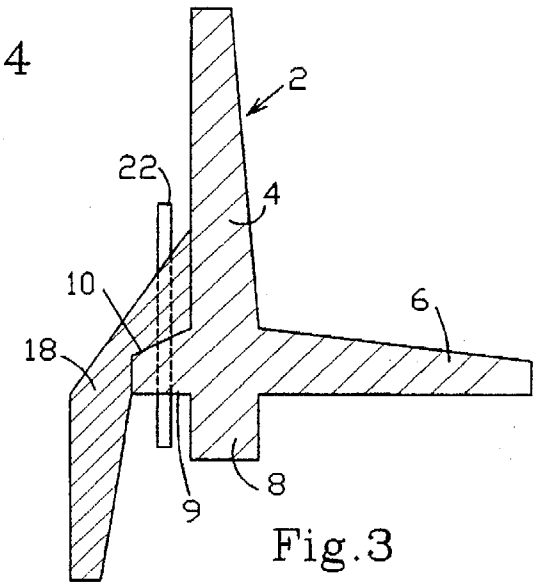
Figure 2:
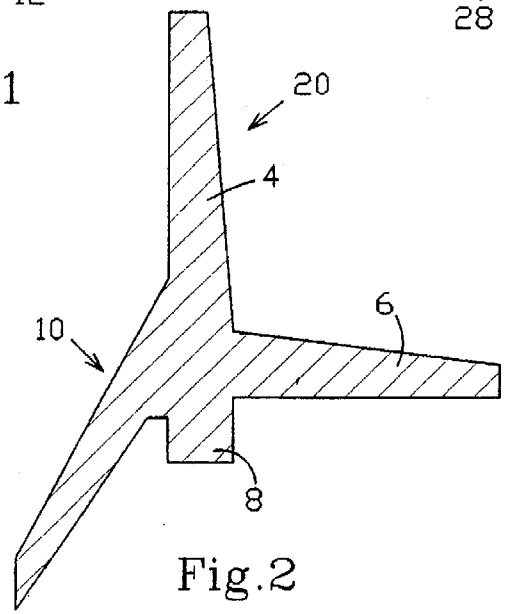

FIG. 2 illustrates a modified L-member (20) in which angular splash plate (10) is extended to reach deeper into the supporting ground (or beach) than key (8). In each case, the angular splash plate breaks up and dissipates wave energy, preventing significant damage to the seawall and preventing scour at the foot of the seawall by wave action or other erosion forces. FIG. 3 illustrates an alternate form of L-member (2) comprising extended angular splash plates (18) which are fastened to the angular splash plates (10) at the base of the standard L-member by pins (22) of rebar or other suitable material. This feature permits the use of the standard L-members of FIG. 1 in a variety of contexts, with extended angular splash plates of suitable angles and depths selected for particular installations. Additionally, the sections of extended angular splash plates can be emplaced to extend across the seams between L-members, thus securing the members together end-to-end when pinned in place. Pins (22) or other fastening means preferably extend into the bottom beneath the footer base (9) to help secure the L-members in place.

FIG. 4 illustrates in cross-section an L-member (2) installed as a portion of a seawall. The base of a bluff or bank has been excavated so that the footer (6) and key (8) are emplaced firmly in the beach surface, with angular splash plate (10) facing seaward. The shoreward side of the member is lined with water-permeable geotextile (25) (discussed below) which will pass water but retain sand. Weep holes (14) are formed in the vertical wall portion, and optionally in the footer as well, to allow drainage. The space behind the vertical wall is filled with suitable granular fill (24) to optimize drainage and anchor the L-members securely in place. Stones or rubble of suitable sizes (26) are emplaced atop the angular splash plate and a layer of geotextile (28) to further protect against scouring at the seaward base of the L-member.

Figure 5:
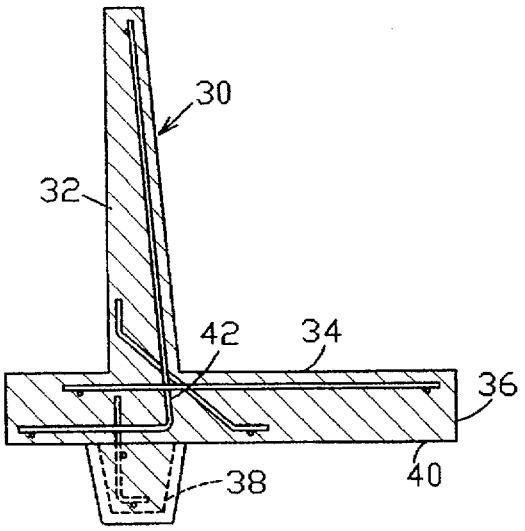
Fig.5 (PRIOR ART)
FIG. 5 illustrates in cross-section a conventional L-shaped unit employed in retaining wall construction in the prior art.

FIG. 5 illustrates a conventional L-shaped member (30) for a retaining wall which provides no protection against erosion from the downhill side. The stem or vertical wall portion (32) is perpendicular to the base (34), a flat slab of essentially uniform thickness which has square corners. The base extends further to the right (36), which is the portion intended to lie under the filled portion of the bank to be retained or reinforced. Optionally, a vertical key (38) can extend below the lower surface of the base (40). The vertical wall and base portions can be reinforced with rebar (42). Depending upon soil conditions, environmental conditions and other factors, the dimensions of the vertical wall and base portions and the type and placement of structural reinforcements can be selected to provide sufficient strength by an appropriate safety margin. The calculations necessary to make such selections are explained in a number of sources, including the *CRSI Handbook*, published by the Concrete Reinforcing Steel Institute of Schaumburg, Ill.

Such calculations can also be used to select the appropriate dimensions of the L-members of the invention, as illustrated below in Example 3.

Figure 6:
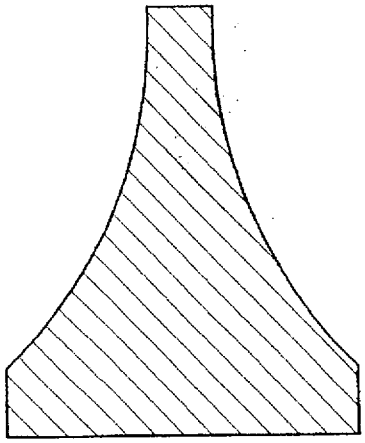
Fig.6 (PRIOR ART)
FIG. 6 illustrates in cross-section a conventional highway safety barrier.

FIG. 6 illustrates a cross-sectional view of a conventional cast concrete highway safety barrier, which items are commercially available in twelve foot lengths of units approximately 3 feet high and 2 feet wide at the base. Because of their commercial availability, applicant used such units for initial tests of shoreline stabilization systems described below in Example 1. Because of their relatively narrow bases relative to their height, however, they are not stable enough to remain in position through long exposure to storms, heavy currents, ice and the like, and are hard to secure to the beach.

Figure 7:
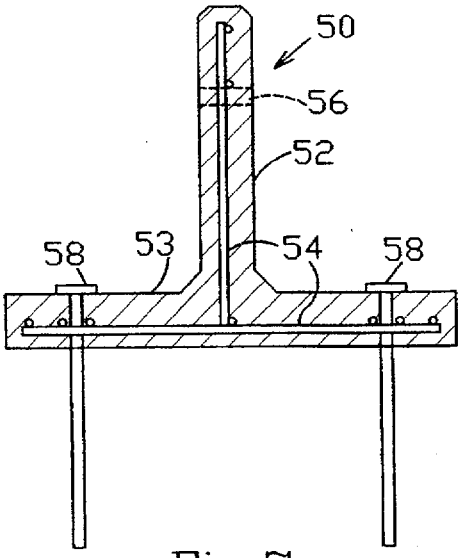
FIG. 7 illustrates in cross-section inverted T-shaped units which can be used for forming systems of the invention.

FIG. 7 illustrates a cross-sectional view of an inverted "T" wall or structural member (50) in accordance with the present invention, having a vertical wall (52) and a symmetric base or footer (53). Such components can be cast of concrete, preferably containing rebar reinforcement (54) as illustrated above for the "L" walls, in various sizes and proportions to suit the application. For example, for shoreline reinforcement systems exposed to water, such "T" walls can range from about 2 to about 6 feet high and from 2 to about 6 feet wide, the ratio of height to width of the base ranging from about 0.6 to about 1:1. The sections can range from about 6 to about 16 feet in length. Particularly when the installed structures will be exposed to tidal flows, strong currents, surf or pack ice, the width of the base and the lowness of the center of gravity should be emphasized to minimize the risk of tipping. A plurality of holes (56) can be formed in the wall to facilitate handling and interconnection. Similar holes in the base permit the use of pins, harpoon type anchors or stakes (58) to secure the units to the beach.

In the present systems, these inverted "T" walls are used to form groins extending seaward from a seawall or bulkhead, and may optionally be used in rows parallel with the seawall as well, as part of a system to reinforce the shoreline, form a "perched beach" or the like. Such groins are typically installed substantially perpendicular to the seawall and are used in pairs or greater numbers. The spacing and length of such groins must be carefully selected to encourage sand, gravel and other material to collect on the beach. In some cases the effects of groins, seawalls and other beach reinforcement systems can be difficult to predict even after careful analysis. Such analyses are beyond the scope of the present disclosure, but some guidelines may be found in "Low Cost Shore Protection", published by the U.S. Army Corps of Engineers.

Figure 8:
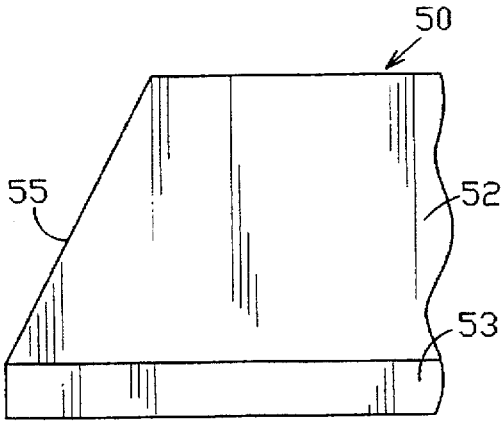
FIGS. 8 and 9 illustrate bevelled versions of these units.
Figure 9:
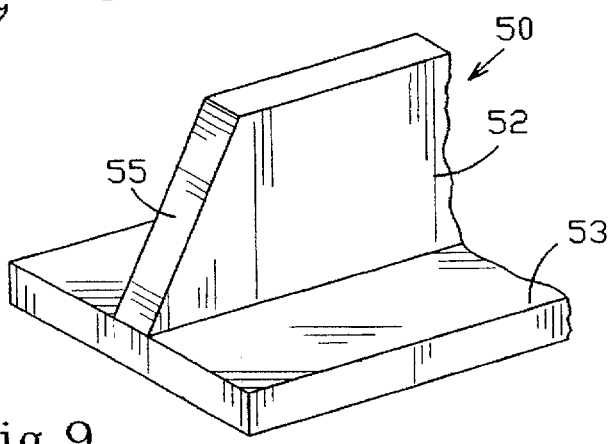
Figure 10:
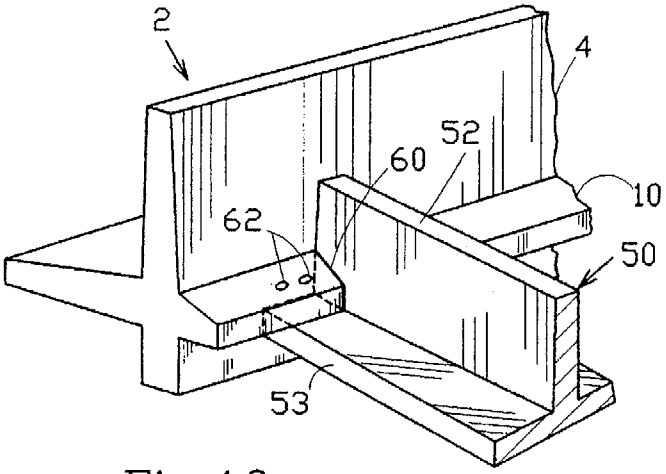
FIG. 10 illustrates joinder of groins perpendicular to a seawall.

When these inverted "T" walls are installed in such groins, or in walls parallel to the beach, in navigable waters, the endmost sections are preferably beveled at the seaward end (55) (as shown in FIGS. 8 and 9) to prevent damage to boats operating nearby. The groins perpendicular to the seawalls are joined thereto as shown in FIG. 10, with base (53) of the groin placed under splash plate (10) of L-wall (2). Stem (52) of the T-wall passes through a slot (60) in the splash plate of the L-wall and butts against wall (4). The members are preferably secured to each other and the beach by pins or stakes (62).

Figure 11:
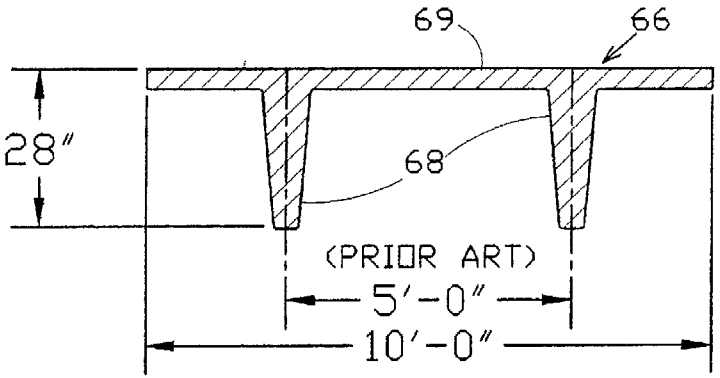
FIG. 11 illustrates in cross-section conventional "double T" or pi-shaped units which can also be used as components of the systems of the invention.
Figure 17:
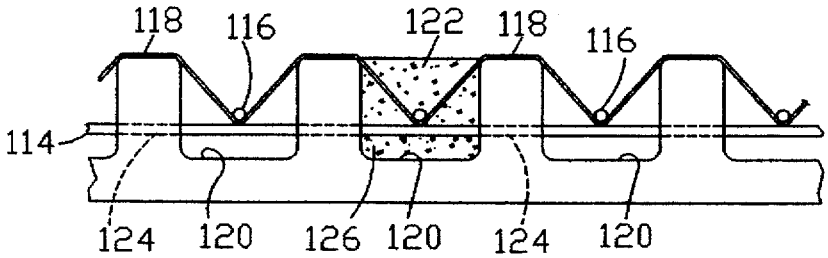
FIG. 17 illustrates methods of casting the above flexible cable-fabric-concrete assemblies.

FIG. 11 illustrates in cross-sectional view conventional "Double T" cast concrete structural members (66) which may be used in systems of the present invention. Such structural members are used in constructing parking garages. The dimensions shown in FIG. 17 are for the typical product, but modified versions could be produced as required. The length of such units can range from about 20 to about 60 feet, with length limited mainly by the difficulties of handling such heavy components over the road and along shorelines where they are to be installed. Because of their dimensions, the two tapered upright sections (68) joined to the flat base portion (69) give the appearance of two "T" shapes joined side-to-side. The units are also known as "pi" units because of their resemblance to the Greek letter pi.

Figure 13:
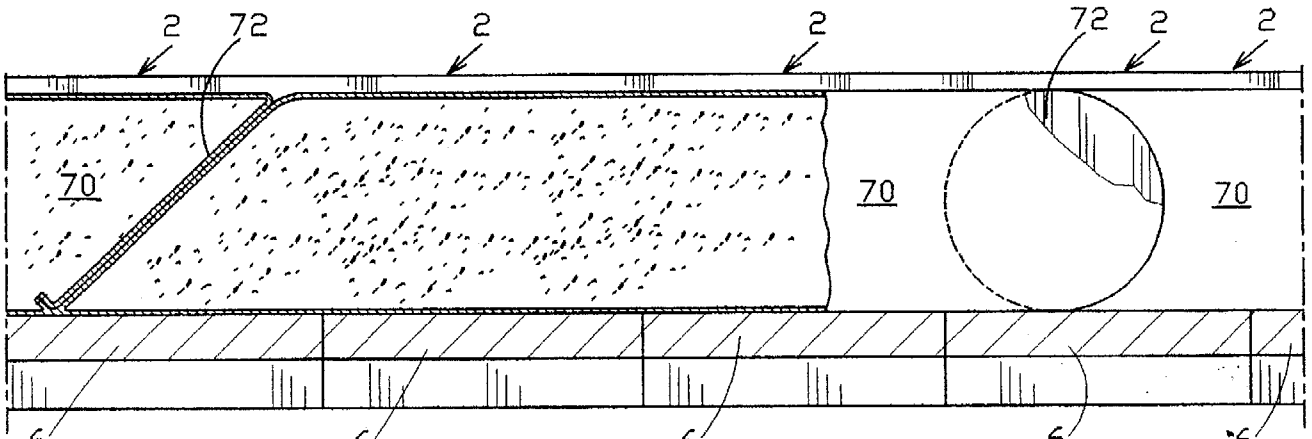
FIGS. 12 and 13 illustrate the use of so-called "geotubes" for retaining sand as a weight on the shore sides of L-shaped units in constructing a retaining wall.
Figure 12:
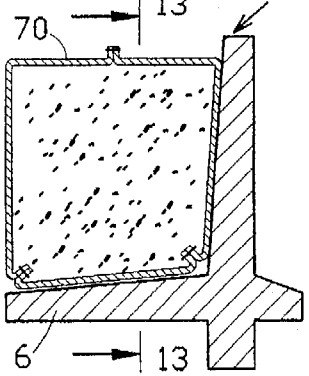

FIGS. 12 and 13 illustrate in cross-sectional view and rear view (from behind the seawall) the use of geotubes for retaining the L-walls in place even when storm conditions cause large waves to break over the walls. As shown in FIG. 12, a series of L-walls (2) are emplaced along the beach at the base of a bluff or bank, and before filling in the material on the footer (6), a geotube (70) is placed along the footers of several such L-walls. A "geotube" is a sausage-like tube of a water-permeable geotextile (discussed below), which is filled with sand, gravel or the like to provide a heavy body which will still allow water to drain through. Such tubes are preferably filled hydraulically or by other mechanized means in place, as they are typically large (ranging from about 2 to about 6 feet in diameter and from about 6 to about 12 feet in length) and are very heavy when filled. The tubes are preferably constructed with an inner liner of less porous geotextile to retain some sand while allowing water to pass through. FIG. 13 shows how the geotubes (70) are emplaced to overlap several of the L-walls (2) to retain them in place, with the ends of each pair of geotubes also overlapping (72) to provide a continuous barrier. Geotubes have also been used on the seaward sides of dunes and cliffs but are preferably shielded from exposure to weather or other damage.

Geotextiles are various fabrics designed for use in structures incorporating and/or adjacent to earth or soil formations. Geotextiles may be woven or non-woven and fabricated of various natural and/or synthetic fabrics which are resistant to moisture and decay. They are commercially available from a variety of sources, including Amoco Textiles and Fibers (Standard Oil of Indiana). Amoco Fibers produces Supac® non-woven geotextiles which are highly permeable to provide drainage as well as Petromat® MB, a material which is essentially water impermeable to provide moisture barriers for foundations and the like. While the present systems normally use water-permeable geotextiles, e.g. to allow drainage while trapping sand behind seawalls or other structures, in some cases geotextiles may be used to provide moisture barriers. For example, when beaches or dunes overlay formations of clay, aggregate, hardpan or other solid formations which do not drain and may swell when wet, it may be desirable to seal off such formations with a moisture barrier.

Figures 14, 15:
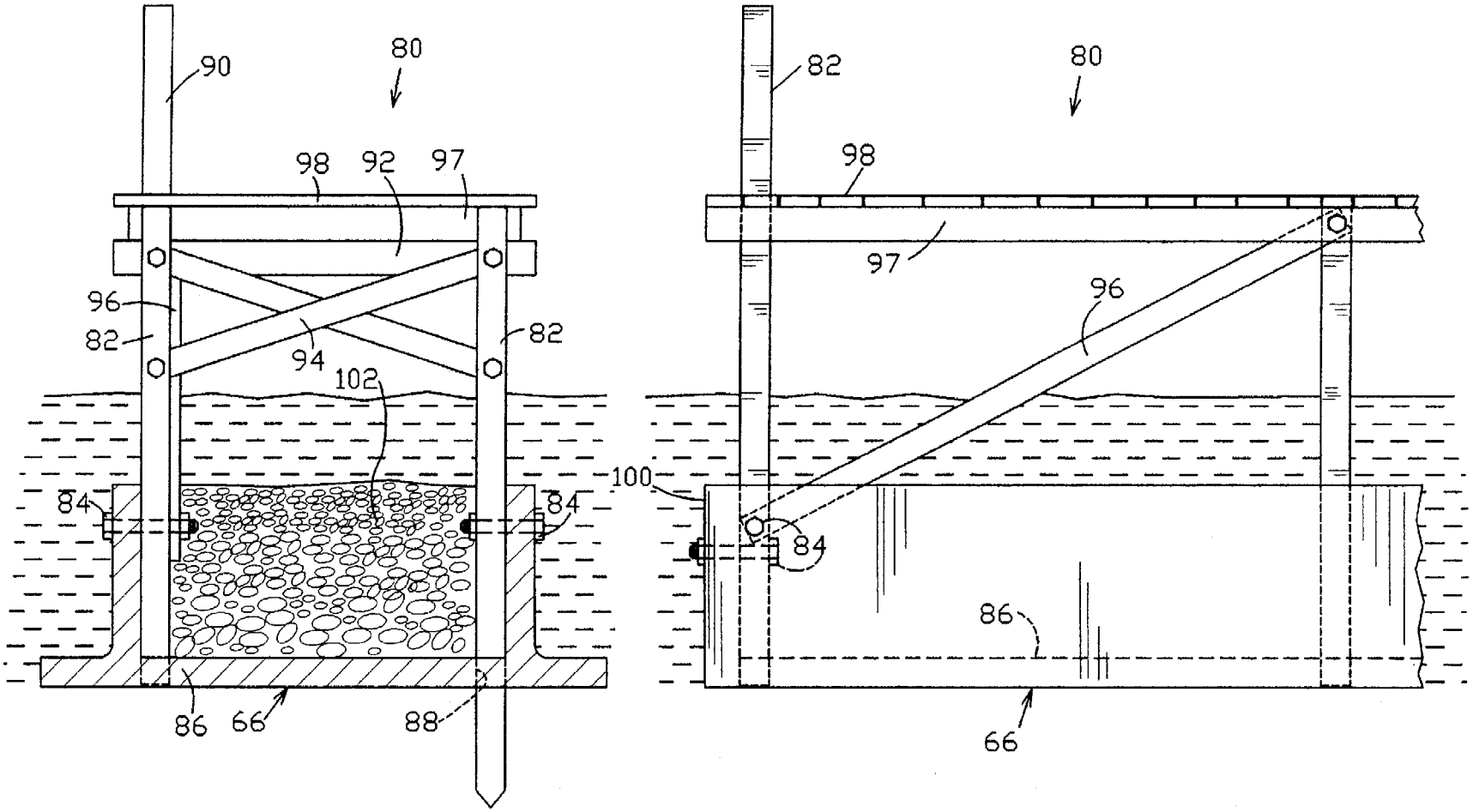
FIGS. 14 and 15 illustrate in cross-section and side views a pier constructed with a foundation including a rectangular structure formed of inverted pi-shaped units which is filled with sand and/or stone.

FIGS. 14 and 15 illustrate in cross-sectional and side views the use of Double "T" units in inverted position as the base for a "pier groin" (80) extending seaward from the seawall. A series of inverted Double "T" units (66) are laid end-to-end and connected with suitable connecting means, the size and number of the units being selected to provide a pier of the desired length.

Figure 24:
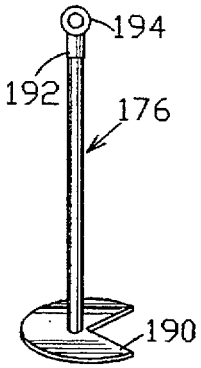
Figure 15A:
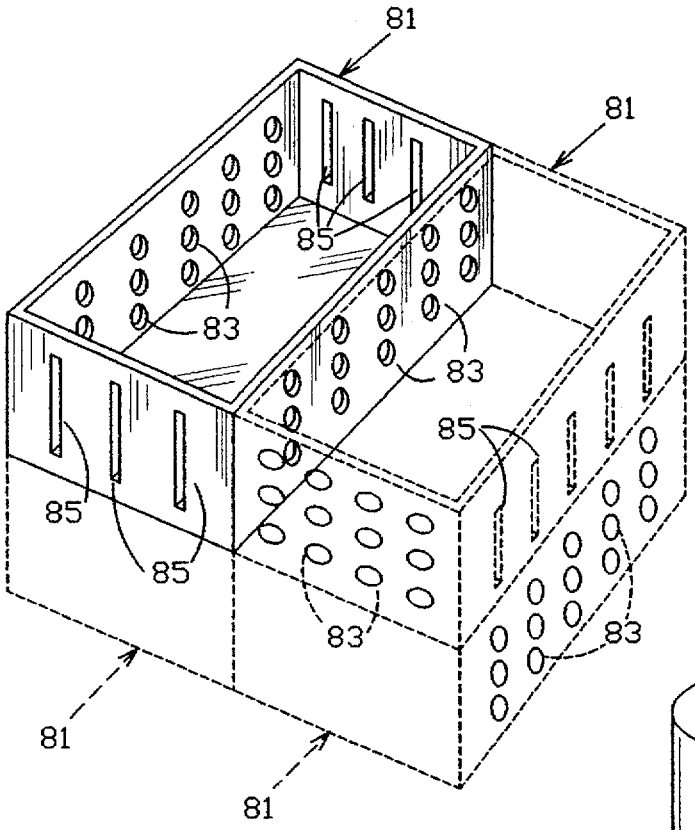
FIG. 15A illustrates precast concrete boxes which can be used in pier foundations and other structures.

As an alternative to such arrangements of inverted double "T" units, precast concrete boxes (such as commercially available septic tank units) can be used. Precast septic tanks come in various sizes, e.g. approximately five feet wide by eight feet long and three feet depth, with walls four inches thick. Such concrete boxes can be used as is, being sunk in position to form the base of a pier groin and filled with sand or debris. However, preferably they are adapted as shown in FIG. 15A, where the box (81) has four sides which have been perforated or slotted with circular holes (83) and/or rectangular slots (85) of a few inches diameter or width. This will make the boxes easier to sink and anchor in position. As with the inverted T units shown in FIG. 7, the boxes can have holes formed in the bottom to accommodate anchoring stakes of rebar, screw anchors such as shown in FIG. 24, or other suitable anchoring means. Preferably plugs are used in the casting molds to form holes (83) or slots 85) which are sealed by thin layers of concrete. Such holes will also make it easier to sink the boxes in the water, as the thin "knockout" portions of the concrete can be punched out once the boxes have been floated into position.

Such perforated and/or slotted boxes can serve an additional function beyond anchoring the foundation of a pier groin or other component. Since waves striking the surfaces of such boxes will be partially interrupted or deflected and partially absorbed by passage through at least one side of the box (i.e., the perforations or slots), their force will be at least partially dissipated. The water inside the boxes remains restricted or "dead" during the time periods of the waves. Thus, such boxes may be used as "wave degeneration cells" as components of the foundations of pier groins, groins parallel or perpendicular to the shoreline, or even breakwaters. The dimensions and arrangement of the boxes as well as the dimensions and locations of their perforations and/or slots are of course selected to suit expected conditions. Additionally, the perforations and/or slots should not extend too close to the base, where they might hinder retention and/or accumulation of anchoring material.

Such a breakwater can be built by anchoring a linear array of the precast concrete boxes so as to form a wall either, e.g., five or eight feet wide, then stacking the units and lashing or otherwise fastening them together to form a breakwater of suitable height. At least the lower layer of the boxes should be at least partially filled with sand, rock or other anchoring material, but vacancies left in some of the boxes will provide shelter for marine life, thanks to the perforations and/or slots which allow easy access.

A series of concrete or wooden pilings (82) are provided at suitable intervals to support the pier groin of FIGS. 14/15. Such pilings can be fastened to the upright portions of the inverted Double T units with bolts (84) or other suitable fastening means, being fitted securely against the base portion thereof (86), or optionally can be lodged in recesses in the Double T-unit bases or even driven through holes (88) in the bases into the beach beneath. The pilings on one or both sides can extend high enough to form a handrail (90). Suitable crosspieces (92), crossbraces (94), longitudinal braces (96) stringers (97) and decking (98) are installed to provide the normal components of a pier. Transverse bulkheads (100) are provided to strengthen and segregate each pier groin unit.

Once all components are installed, the space between the uprights of the inverted Double T units (or inside concrete boxes) is filled with rock, sand, gravel or other sediment (102) by pump or other hydraulic or mechanical means to initially anchor the units in place. In most installations, sand and sediment will collect by accretion inside and on at least one side of the Double T-units to further retain them in place.

Figure 25:
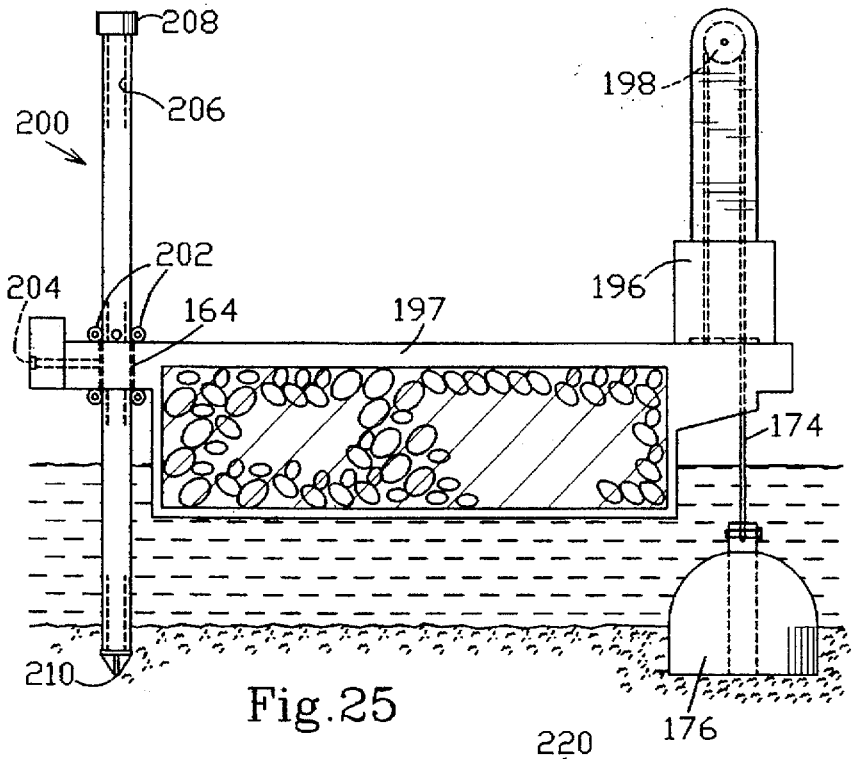

In a preferred embodiment, pilings for the pier groins and other needs may be hollow concrete or metal pilings which are hydraulically driven. As illustrated in FIG. 25, the central longitudinal channel (206) in the cast concrete piling (200) permits high pressure water and/or air to be directed through the piling to the tapered nozzle tip (210), which is placed against the bottom and held in place. In sandy or muddy areas, the hydraulic jet effect of the water flowing through the piling will gradually wash away the soil under the tip of the piling, allowing it to settle into its own hole. Some final tamping or settling may be required.

Various revetment or reinforcing mats for erosion control are known in the art. For example, U.S. Pat. No. 1,173,879 to Shearer (issued 1916) illustrates revetment mats which may be installed by the apparatus disclosed in Shearer's U.S. Pat. No. 1,229,152. U.S. Pat. No. 4,375,928, incorporated herein by reference, discloses and claims "Flexible Concrete For Soil Erosion Prevention," comprising rectangular concrete blocks arranged in a grid and interconnected by cables on all sides as well as thin, breakable concrete bonds. Such assemblies can be obtained commercially from International Erosion Control Systems of West Lorne, Ontario, Canada as "Cable Concrete".

Figure 16:
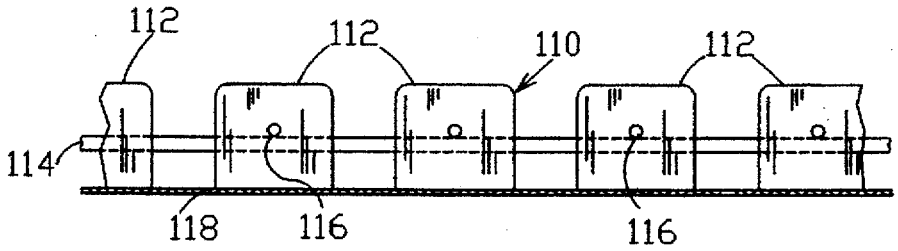
FIG. 16 illustrates a flexible assembly of fabric, cables and concrete sections or "ties" which is useful for reinforcing beach areas against erosion and as boat ramps.

Although such Cable-Concrete mats can be used in the present invention, it is presently preferred to use flexible concrete mats (110) such as illustrated in FIG. 16. Rectangular sections of concrete (112), typically ranging from about 4 to about 12 times as long as they are wide, are connected together side-to-side by cables (114) or other suitable connecting means. Connecting means should be provided at each side to retain the concrete "ties" (resembling railroad ties in their proportions) in place during transport and installation. Connecting means may comprise cables or chains of stainless steel, galvanized steel, bronze alloys, plastic-coated steel or other corrosion-resistant materials. The cables may also comprise synthetic fibers such as polyesters, polypropylene and the like. Preferably, each concrete "tie" is cast containing at least one rebar reinforcing rod (116). Each concrete mat unit, assembled in sizes of approximately 4 feet wide by at least 8 feet long, preferably includes a section of geotextile (118) attached to one side (the "bottom") of the unit, which will allow sand to settle between the ties while water drains through the geotextile. The finished mats are flexible and can be rolled or folded and transported to the installation site by any suitable means before being installed by unrolling or unfolding in the desired installation site. These mats are useful as portable boat ramps and for erosion control of beaches, dune formations and various soil formations.

FIG. 17 illustrates a method of fabricating the cement mats described above. A series of molds (120) for molding ties of the desired size are spaced so as to provide a desired spacing of the finished ties in the mat. The molds are wider at the top than at the bottom to facilitate removal of the molded ties. Connecting cables (114) are laid through slots (124) in the molds so as to extend through each of the molds to fasten the molded ties together. After an initial layer of concrete (126) is poured into each mold to cover these connecting cables, at least one section of rebar (116) is positioned in each mold to provide reinforcement. The rebar sections are preferably positioned on the folds of a length of optional geotextile (118) which passes longitudinally from mold to mold to provide a second connecting means between the molded ties. When the geotextile and all reinforcing bars are in position, each mold is carefully filled with concrete (122) to cover the geotextile and rebar and fill the mold completely. The cured product comprises reinforced concrete ties interconnected side-to-side by at least a pair of cables or other connecting means, and sections of geotextiles attached to the "bottom" of each tie.

Figure 17A:
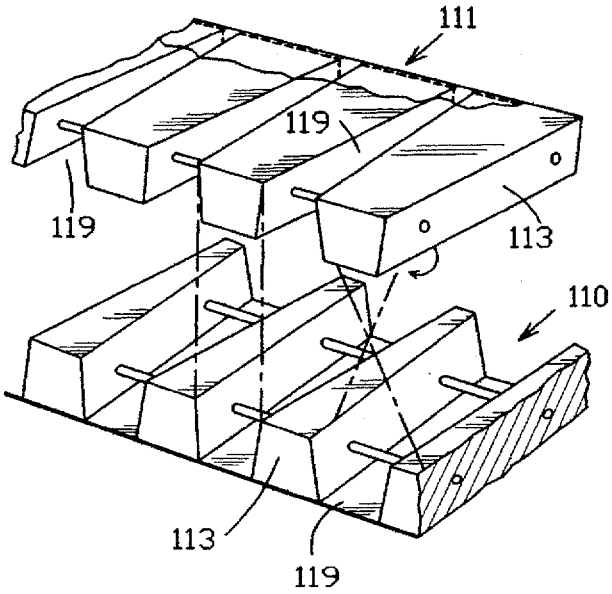
FIG. 17A illustrates flexible mats having tapered ties which permit the mats to be assembled in interlocking fashion.

The concrete mats of the invention are normally installed abutting side by side parallel or perpendicular to the shoreline in single layers, with the geotextile surface down. However, when the mats are fabricated with trapezoidal "ties" having the smallest side upward and the ties are separated at their bases by a space of at least the width of the largest parallel side of the ties, a second layer of the mat can be installed atop or alongside with the ends overlapping the first layer in inverted interlocking position to form a substantially solid structure of concrete, connecting means and geotextile in which the remaining spaces will gradually fill in with sand and gravel. This can be advantageous for surfaces subjected to severe erosion, such as beaches in areas of heavy weather and/or high tidal ranges, and embankment areas along highways, in housing developments and the like. In addition to fabricating the concrete mats so that the trapezoidal ties of one mat will interlock with the spaces between the ties of another (preferably with the longitudinal connecting cables positioned relatively near the lower sides of the ties), the ties can be designed and cast to interlock in such a way as to limit lateral movement when an inverted mat is installed atop a foundation mat. For example, FIG. 17A shows that the concrete ties (113) can be molded to be tapered, or wider at one end than the other. In the molded/assembled mats, all the ties are aligned in the same direction, so that the widest spaces between ties lie between the narrow ends of the ties. When a first layer of mat (110) is laid down on the beach, e.g., with the widest ends of the ties facing seaward, the openings between the ties will range from widest to narrowest between the shoreward and seaward ends. Thus, when a second layer of mat (111) is placed atop the first layer, by orienting the ties in the direction opposite to that of the ties in the first layer, the tapered ties (113) of the second layer of mat can be wedged into the tapered channels or spaces (119) between the ties of the first layer, making them hard to dislodge by either gravity or wave action. Any suitable configuration of the ties in the mats can be used to allow one layer of mat to interlock or adhere by frictional force.

Figure 18:
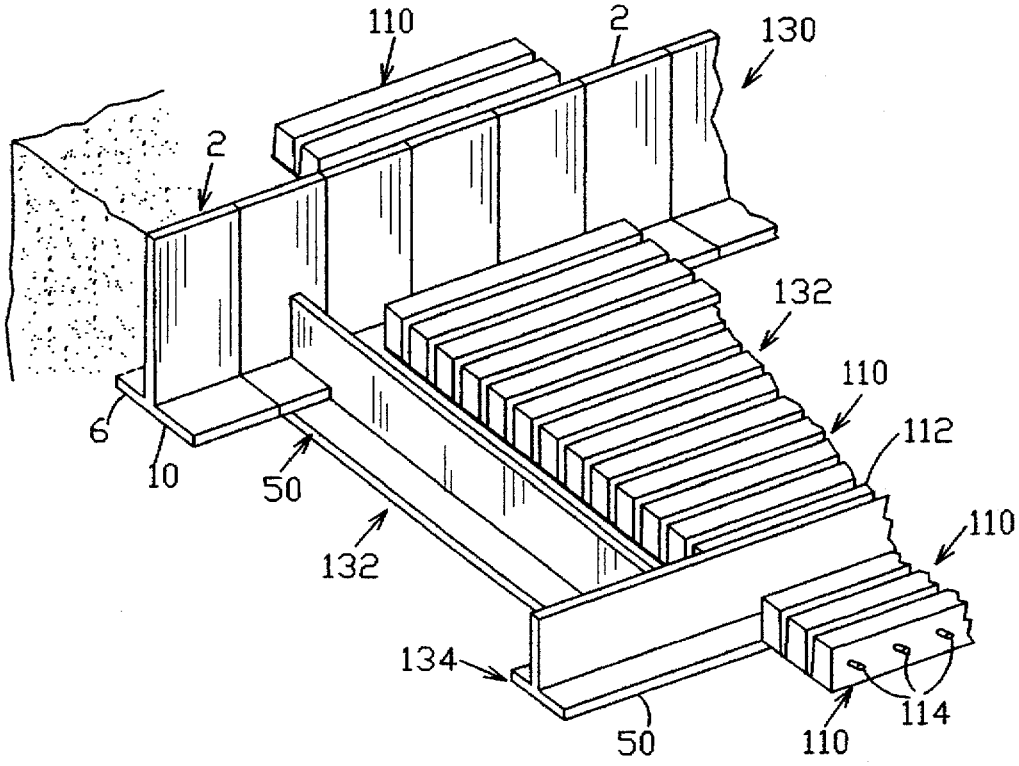
FIG. 18 illustrates a seawall and beach reinforcement system including a seawall, at least one groin built of inverted "T" structures, at least one row of inverted "T" structures parallel to the seawall, and flexible cloth-concrete cable or chain assemblies emplaced in conjunction with same.

FIG. 18 illustrates a shoreline reinforcement system installed along a shoreline having a sloping beach, a low bluff and sand dune systems shoreward of the bluff. A series of L-members (or large T-walls) (2) are installed along the base of the low bluff to form a seawall (130), with footers (6) being covered by rubble and fill graded down from the dune systems. Splash plates (10) of the L-members protect against scouring by wave action. Preferably, small rocks under armor stone are used to cover the splash plates to further resist scour (not shown in this figure; see FIG. 4). Several groins (132) perpendicular to the seawall are formed by inverted T walls (50), extending down the beach and along the shoreline to protect the areas most vulnerable to erosion. Preferably the inverted T-walls are secured to the seawall, as shown in detail in FIG. 11, by having base sections (53) of the inverted T inserted under splash plate (10) of the wall, with the stem (52) of the T passing through cut (60) in the splash plate. Additionally, at least one series (134) of inverted T-walls (50) is installed parallel to the seawall, further down the beach. This provides a stronger reinforcing structure and has the added beneficial effect of helping to form a "perched beach" or area where sand, pebbles and other desired material can accrete. Concrete reinforcing mats (110) such as Cable-Concrete or the interconnected concrete tie mats disclosed herein are installed behind the seawall to protect against storm damage; between the seawall and the row(s) of inverted T-walls parallel thereto to protect the beach from erosion and allow for further accretion of sand, etc.; and below the lowest line of inverted T-walls to protect against scour. All the concrete components are interconnected by suitable connecting means or fastening means at their points of contact, such means being described below.

Although seawall sections must be protected against the daily erosive effects of tidal, current and routine storm effects, the sand dune systems behind the beaches are also vulnerable to wind and storm. In some barrier island systems, hurricanes or great storms can cause massive damage to such dune systems, in some cases effectively destroying the usefulness of the property as human habitat. The systems of the present invention can also be used to reinforce and protect dune systems against such catastrophic effects, while remaining hidden from view at most times due to the accretion of sand through normal actions of the winds, waves and tides.

FIG. 19 illustrates such a system in cross-section. Sand in the dune systems (140) above the beach (142) has been moved aside to allow installation of the system, then graded back to cover the system and reform the dunes. As with the system shown in FIG. 18, a series of L-walls or T-walls (50), as shown, are emplaced, with soil (or sand) being filled in to cover the footers and retain the walls in place. Since these units will not usually be subjected to direct erosion, inverted T-walls may be used in place of L-walls. A series of concrete tie mats (110) emplaced behind this "underground seawall" helps to stabilize the L-members or T-walls. Groins of inverted T-walls may be extended down the dune system from the upper wall (not shown here) as was done in FIG. 18. At least one additional row of T-walls are installed under the dune system, parallel to the upper wall. Sets of concrete tie mats (110) are installed below the upper wall (144), extending to and beyond the lowest set (146) of inverted T-walls. This system insures that even if the loose sand forming the visible portion of the dune system is blown or washed away by storms, the underlying foundation of the dune area will be maintained by the system of concrete mats, anchored by the upper wall and lower row(s) of inverted T-walls. Such systems may be more difficult and expensive to emplace than other systems proposed for beach areas, but in areas which are to be developed and used extensively for recreation, the investment may be well justified as an alternative to having expensive real estate and improvements alike washed away by major storms. The installation of such systems is of course more efficiently accomplished on a regional basis, before extensive development and road building has taken place. In addition to protecting dunes, the system of the invention can be used to prevent erosion or damage to hillside soil formations, the bottoms of bodies of water where cables or pipelines are laid, and the like.

FIG. 20 illustrates a pier structure which may be constructed as part of a shoreline reinforcement system of the invention. At least one pier groin system (150) extends from a seawall (130) seaward, with an end bulkhead (152) at the seaward end of each unit. In water which is deeper and subject to tidal action, at least one floating pier section (154) is attached to seaward of this. To afford sufficient space for boat moorings and recreational purposes, another floating pier section (156) is attached to the outermost floating pier section to form a "T" pier structure. The floating pier sections can be supported and retained in position by any suitable positioning means consistent with the shoreline reinforcement system installed on the beach below. However, certain preferred methods are discussed below.

FIG. 21 illustrates a floating pier unit (154) fabricated of precast concrete, containing void (158) to provide buoyancy. Such voids can be filled with buoyant materials (160) such as cast or particulate plastic foam, hollow bodies such as ping-pong balls, or the like. Such pier units can be cast to order, or commercially available precast concrete boxes such as septic tanks (FIG. 15A) can be used. The pier section is retained in position by pilings (162), upon which it rises up and down with the tide by openings (164) with rollers (165) or suitable fittings encircling the pilings. Such arrangements are merely representative of positioning means used to retain floating pier units in position despite the influence of tides, currents and weather. Such pier sections may be conveniently transported using towing rigs disclosed and claimed in applicant Veazey's U.S. Pat. No. 5,176,394, which is incorporated herein by reference. In the systems described, the solid pier groin sections provide strength and accumulate sand, while the floating pier section (s) can be raised or removed for winter and will not accumulate sand underneath.

FIGS. 22 and 23 illustrate an alternate positioning means for a floating pier unit which does not require pilings. The form of the floating pier unit is substantially as in FIG. 21, but in place of apertures or fittings to slide over pilings, each corner (at least) of the unit is fitted with a cylinder (170) containing a spring-loaded (172) cable or chain (174) connected to an anchor. In operation, anchors (176) at each corner hold the pier in position because springs (172) maintain tension on each anchor cable (174). At low tide (FIG. 22) the spring presses disc (178) or other retaining means, which is connected to cable (174), upward to apply tension to the cable, up to the limit imposed by the top (180) of the cylinder (170). Since each cable is subjected to such tension, the lateral and vertical movement of the pier will be limited. As the tide rises (FIG. 23), the buoyant force of the floating pier causes the springs (170) to compress, maintaining tension on all cables while allowing the pier to rise with the tide. Any suitable cable and anchor means may be used for these applications, but the cable is preferably corrosion-resistant metal cable or chain, having a shape and size suitable to run freely through the holes (182) in the pier. Preferably anti-friction bushings (184) are used to line the holes through which the cables pass.

The anchors can be simple weights of metal and/or concrete, perhaps as simple as a bucket or drum filled with concrete. However, for permanent installations attention must be paid to the strength and corrosion resistance of the connecting means between cable and anchor. A preferred form of anchor (176) which is commercially available or can be fabricated is shown in FIG. 24. A shallow helical drill bit (190) serves as the base of the anchor and can be driven into soft bottoms by rotating stem (192) to emplace the anchor. The diameter of the drill base section and the length and diameter of the stem are chosen to provide generous margins of safety for proper installation and retention of position once emplaced. The cable is then attached to the stem ring (194) or other connecting means such as cable clamps, shackles or the like.

Other alternative positioning means for floating piers are shown in FIG. 25. Multiple anchors (176) and cables (174) are used at the corners of the pier as in FIGS. 22 and 23, but tension is maintained by a pulley and counterweight system. In operation, at lowest low tide the cable (174) is retracted, so that the weight (196) barely rests upon the deck of the pier (197) as shown, maintaining tension on the cables. As the tide rises, the cable portion over the pulley (198) shortens, until (at high tide) the counterweight contacts the pulley and can travel no further.

FIG. 25 also illustrates a form of self-driving piling which can be employed to install floating pier units in accordance with the invention. At the left of the figure, piling (200) is shown passing through aperture (164) in the pier, which is lined with rollers or wheels (202) to facilitate the passage of the pilings through a relatively small aperture which restrains the lateral motion of the pier. Additionally, retractable pins or bolts (204) are installed so that the pier can be secured in a given position by removably securing each pin in position against the pilings. In the finished pier installation, this permits locking the pier in the high tide position for maintenance or winter storage. In the installation process, locking the pier in place at a high tide position also permits the weight of the pier to be used to drive the piles.

The pilings used are cylindrical steel or cast concrete bodies with a central channel (206) extending the full length. The concrete pilings preferably incorporate longitudinal reinforcements (not shown). Fittings (208) are provided at the top for the connection of a fire hose or other suitable hose which may be connected to a portable pump. When water and/or air is passed under pressure through the pilings, the pier being mounted above water with the pilings partially driven into the bottom, the water passing through the sharp nozzle tips (210) of the pilings sweeps away mud, sand and aggregate on the bottom and allows the pilings to gradually settle into the bottom aided by the dead weight of the pier. The process of pressurizing the pilings can be simultaneous (if enough pumps, hoses and fittings are available) or sequential, with care taken to finally drive each piling to a comparable depth.

The present invention therefore encompasses a self-driving piling system for floating piers, comprising a floating pier assembly having at least four apertures for the passage of pilings for support of the pier, with guiding means for each piling as it passes through its aperture and securing means adapted to fix the pier in a position where its full weight will bear down upon the pilings when they are in position for driving. Each piling, which may be constructed of concrete, metal or other suitable materials, contains a central channel extending longitudinally through the entire piling, with connection means allowing the connection of suitable hydraulic hoses at the top. When pumps or other suitable pressurizing means are used to force water and/or air into the pilings, the fluid(s) emerges through the pointed nozzle ends of the pilings, causing them to dig themselves into position by hydraulic jet action.

Figure 25A:
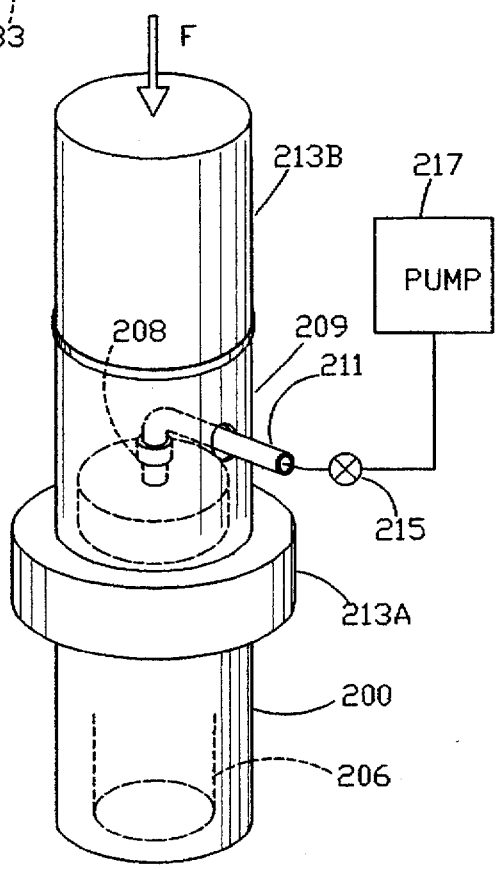
FIG. 25A illustrates details of a self-driving piling assembly including a protective cap, pumping means and vibrating means.

Whether or not the weight of a floating pier is used to facilitate the self-driving of such pilings in accordance with the invention, the pilings may be driven into their final positions by the application of external downward force to a protective cap as shown in FIG. 25A. In this figure, piling (200) contains central channel (206) and fittings (208) for connection (215) with external pumping means (217). Protective cap (209) is attached removably to the top of the piling by suitable fastening means (such as bolts, pins, pegs and slots, etc.) so that external forces applied to the top of the cap are transmitted to the piling. At the same time, the cap shields the fittings (208) from damage while allowing hoses (211) or other connecting means to be connected for the pumping of fluid(s) in the driving of the piling. Such protective caps can be fabricated of suitable metals, woods, plastics or reinforced plastic composites.

Whether the piling is driven by the weight of an attached floating pier and/or external forces or merely by its own weight, the erosive effects of the fluid(s) pumped through the nozzle (210) (shown in FIG. 25) and the settling of the piling into its driven position can be augmented by the application of suitable vibratory forces by vibrating means, shown schematically (213) in FIG. 25A. Any suitable vibrating means suitable to the particular installation can be used, and will expedite the hydraulic driving of the pilings. For example, a vibrator assembly (213A) may be designed to be removably fastened around the circumference of the pilings, as shown, or may be incorporated in a weight or hydraulic plunger (213B) which is used to apply a downward force (F) to the top or the protective cap (209) of the piling (also shown). For example, hydraulic tampers similar to those commercially available for back hoes can be employed.

Figure 26:
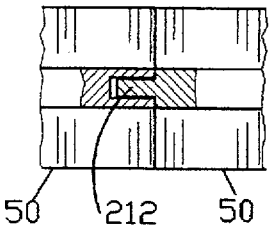
FIGS. 26 through 31 illustrate various methods of interlocking the L-walls or T-walls end-to-end.
Figure 28:
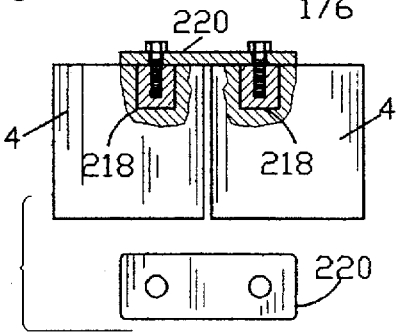
Figure 27:
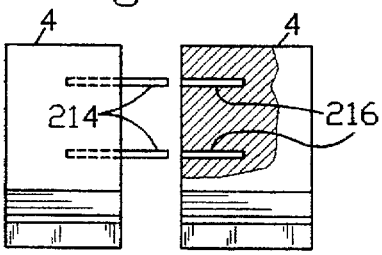
Figure 29:
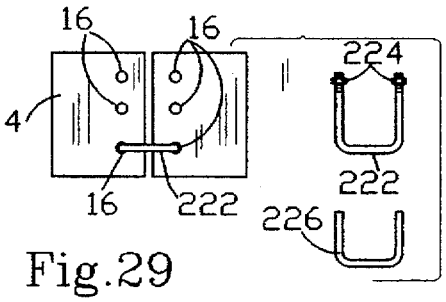
Figure 30:
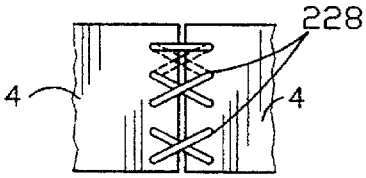
Figure 31:
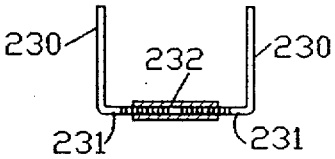

As mentioned above, the precast concrete components which are used in the systems of the present invention must be securely fastened together to form durable seawalls or other components. Any suitable connecting or fastening means can be used for such purposes, with the proviso that hardware, cables and other components should be of corrosion-resistant materials such as stainless steel, galvanized steel, bronze alloys, plastic composites or the like. In fastening together sets of L-walls or inverted T-walls which are butted together end-to-end, for example, as illustrated in FIG. 26 the walls (50) can be cast to incorporate interlocking tongue-to-groove (212) or other patterns. As shown in FIG. 27, sections of rebar (214) can be cast into positions in the sides of the L-wall sections (4) in positions suitable to fit into corresponding holes (216) in the sides of the adjacent L-wall section. Various brackets and connecting bars can be used. For example, as illustrated in FIG. 28, threaded metal inserts (218) can be cast into the tops and/or faces of the L-wall sections (4) near their edges, allowing metal connecting bars (220) to be bolted on once the L-wall sections are in place. FIG. 29 illustrates a pair of L-wall sections (4) having a series of holes (16) near their adjacent edges. Using these holes, the sections can be connected together with large U-bolts (222) and nuts (224), sections of rebar (226) or other metal rod which are bent to fit into two adjacent holes, or even cable (228) threaded through an adjacent set of holes like shoelaces (FIG. 30). As shown in FIG. 31, L-shaped sections of metal rod (230) which are threaded at one end (231) may be inserted into adjacent sets of holes, then tightened in position by threading the two threaded ends (one being a left-handed thread) into the ends of a threaded cylinder (232) which acts like a turnbuckle.

EXAMPLES

The objects and advantages of the present invention will be further illustrated by the following non-limiting examples.

EXAMPLE 1

Use of Highway Safety Barriers to Reinforce Shoreline

Applicant Veazey's property in King George, Va. adjoins the Potomac River, with tall bluffs and a narrow beach marking the river bank. The Potomac is tidal at this point, the range of tide being a maximum of about 1.5 feet. The current is strong during the ebb tides, large chunks of ice are present during the winter, and thunderstorms occur frequently. Under all these influences, extensive erosion of the river banks was taking place. In 1984, several rows of conventional highway safety barriers (shown in cross-section in FIG. 6, approximately 3 feet high and 2 feet wide at base in 12 foot lengths) were emplaced, some parallel to the river bank and others extending into the river roughly perpendicular to the river bank. By 1994, some of the barriers had been tilted over and/or slightly separated from each other, and flotsam and jetsam was deposited on top of some of the barriers. This indicated that higher barriers would be appropriate to maintain a clean beach, and that to form a permanent barrier or groin, the components would have to be fastened securely together and preferably to the bottom as well. Some desirable effects were achieved in that sand had been deposited between several of the groins and along the seawall, and the bank had been protected from significant erosion. This suggested the merits of a coordinated system of reinforcing components to protect the river bank and nourish the beach on this and similar waterfront properties.

EXAMPLE 2

Use of Double-T Components

About 1986, an effort was made to install several Double-T units on another Potomac beach to serve as groins. These units, illustrated in FIG. 11, are used in the construction of parking garages and come in 60 foot lengths of 10 feet wide. As such, they are very heavy and cumbersome to handle. In handling them on the beach, one broke when it was placed on uneven footing, and it was very difficult to emplace them due to their weight and size and the need for heavy equipment in a sandy environment. It was concluded that although such shapes could be useful, handling such lengths was infeasible, and cutting them into shorter lengths made them easier to handle, but was laborious and time-consuming in itself. Some of the Double-T sections were emplaced end-to-end and joined together with concrete. Although difficult to move, the Double-T sections were found to provide useful footings for piers and the like when emplaced in inverted position and filled with stone, rip-rap or the like to quickly weight them into position.

EXAMPLE 3

Proposed System for Reinforcing Potomac River Bank at Colonial Beach

Figure 32:
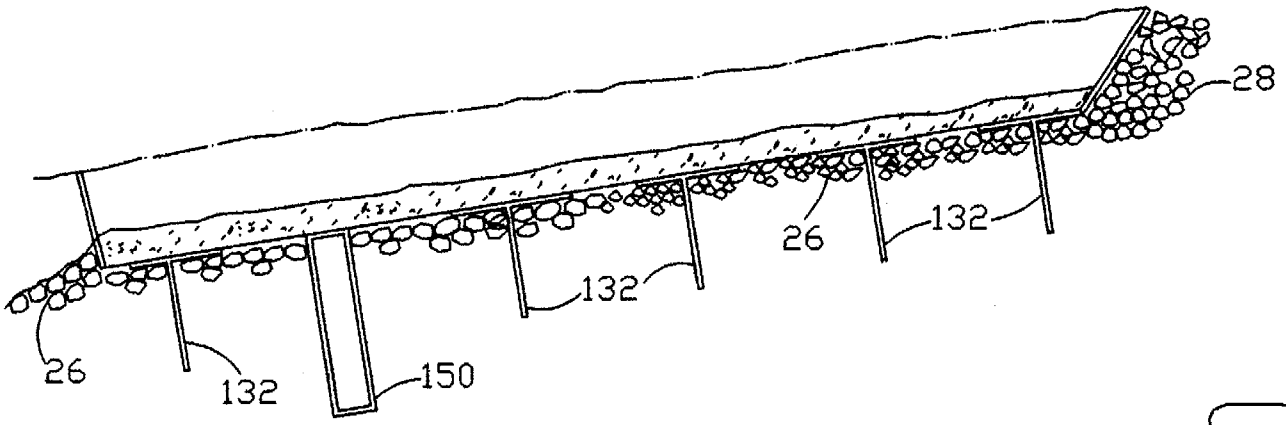
FIGS. 32 and 33 illustrate a seawall and reinforcement system designed for installation along the Potomac River shoreline in Virginia.
Figure 33:
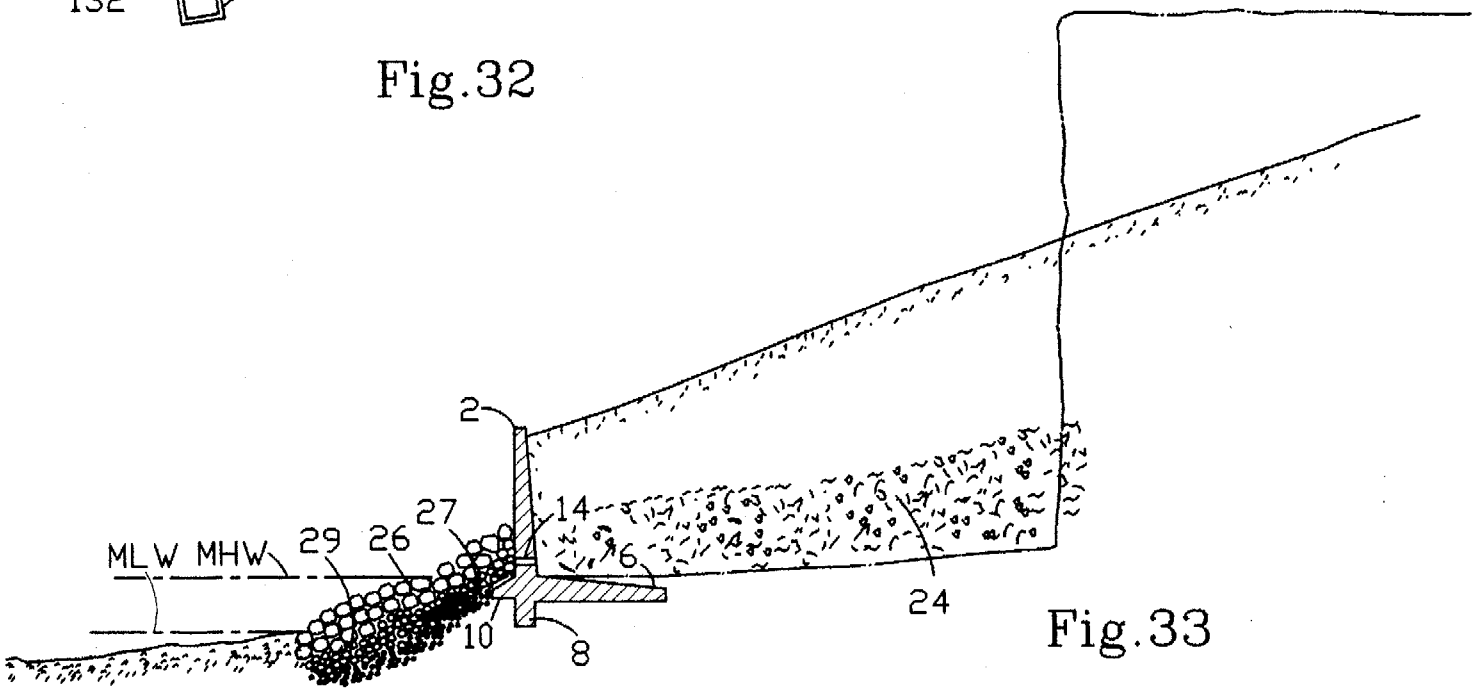

Applicants have designed and propose to build and install the system shown in FIGS. 32 and 33 for reinforcement of the Potomac River bank on residential property at Colonial Beach, Va. Starting at the upper (northern, upriver portion) of FIG. 32, a portion of the bank will be bevelled and protected by armor stone (28) against erosion by the current. The angle of the bevelled portion is expected to help to deflect floating debris, ice and the like. Approximately 200 feet of the bank will be reinforced by sections of L-walls (2) installed as shown in detail in FIG. 33. After entrenching the beach below the bank and positioning the L-walls with their keys (8) firmly placed and levelled, the upper bank will be graded and used to fill over granular fill (24) (rocks, gravel and sand) that have been used to cover footers (6) of the L-walls. Weep holes (14) are provided in the L-walls for drainage, and the walls will be joined end-to-end by bolts or other suitable connecting means. The splash plates (10) of the L-walls will be covered first with core stone (27) over a layer of geotextile (29), then with armor stone (26) to protect against storm and ice damage. The southern/downstream end of the wall will also be protected by armor stone (26).

A series of five groins (132) will be installed, extending approximately 20 feet from the wall and approximately perpendicular thereto. The groins will be formed of inverted T-walls approximately 3 feet high by 3 feet wide, and will be placed so as to nourish the present beach with sediment. A pier groin (150) will also extend from the wall in a perpendicular direction, for about 30 feet. The pier groin will be constructed of inverted "Double-T" units. This system is expected to protect the presently eroding river bank, encourage accretion on the present beach and enhance recreational use of the area.

The size of the inverted T-walls appropriate for use in groins was estimated from applicant's previous experience with highway safety barriers which allowed debris to collect behind groins and barriers. To determine the size of the L-walls needed to provide sufficient reinforcement for the graded bank and confirm possible sizes for the T-walls, standard calculations were developed as follows.

PRECAST CONCRETE RETAINING WALL

Soil Characteristics

Unit Weight = 100 PCF (Conservatively light).
Equivalent Fluid Pressure if level backfill = 45 PCF.
Used Equivalent Fluid Pressure
if Backfill slopes 2:1 = 70 PCF Horizontal
active vertical component (4/7) Horizontal
Coefficient of friction for Sliding = 0.55.
Passive Pressure = 400 PCF.
Max Backfill Slope = 2:1.
Backfill is drained using weep holes.

Materials

Concrete = 3000 PSI @ 28 days
Rebar = Grade 60

Analysis

Min. Safety Factor for overturning
about Toe = 2 (Actual F.S. = 3.31)
Min. Safety Factor for sliding = 1.5
Actual F.S. = 1.61

For L-shaped walls as depicted in FIG. 1, with total wall height of 5'8", key depth below the footer of 1'8" and total length of footer and splash plate of 5'8", the length of the units being about 10 feet, the following system of reinforcing bars (rebars) should be satisfactory; more can be used if desired. As shown in FIG. 1, #4 rebar is used horizontally in the wall at a 16" spacing, six lengths being used in all, with additional lengths being used at the extremities of the footer and the splash plate. Vertical reinforcement is provided by bent portions of #4 rebar as shown, spaced every 18", and horizontal reinforcement for the footer-splash plate is provided by additional bent lengths of #4 rebar, also spaced every 18".

Figure 34:
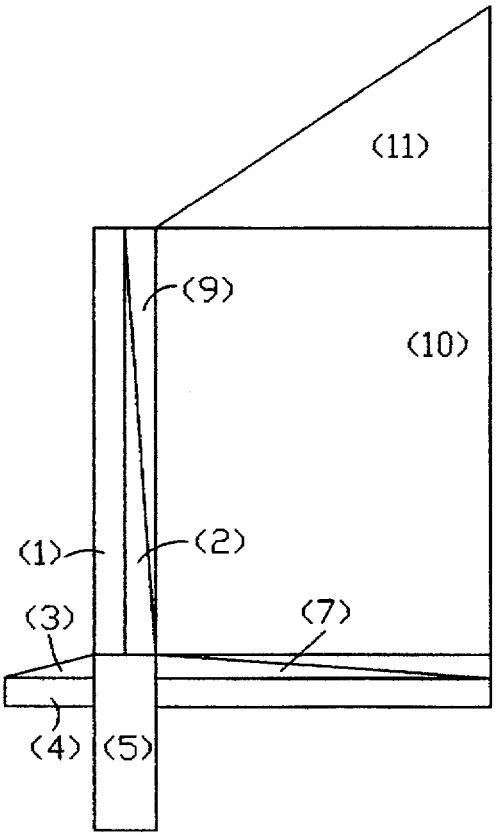
FIGS. 34 through 37 support calculations for designing the installation of FIGS. 32 and 33.

FIG. 34 provides a model and force diagram of the wall when installed, with circled numerals representing weights bearing upon various portions of the wall. The dimensions of the wall are also provided for reference. The horizontal force on the wall is given by $$H=\tfrac{1}{2}(0.07)(7.83)^2=2.15 \text{ kips.}$$

The vertical force on the footer and splash plate is given by $$V=\tfrac{1}{2}(0.04)(7.83)^2=1.23 \text{ kips.}$$

The following calculations will determine the installed wall's resistance to overturning and sliding. Numbered components of FIG. 34 are calculated with ① through ⑦ representing concrete at 150 PCF and ⑧ through ⑪ representing backfill at 100 PCF.

| | AREA SQ. FT. | WEIGHT (KIPS) | HORIZ. DIST. FROM POINT Ⓐ (FT.) | HORIZ. DIST. X WEIGHT (FT.-KIPS.) |
|---|---|---|---|---|
| ① | 0.833 | 0.125 | 1.444 | 0.181 |
| ② | 1.667 | 0.25 | 1.167 | 0.292 |

-continued

| | AREA SQ. FT. | WEIGHT (KIPS) | HORIZ. DIST. FROM POINT Ⓐ (FT.) | HORIZ. DIST. X WEIGHT (FT.-KIPS.) |
|---|---|---|---|---|
| ③ | 0.167 | 0.025 | 0.667 | 0.017 |
| ④ | 0.333 | 0.05 | 0.5 | 0.025 |
| ⑤ | 1.556 | 0.233 | 1.333 | 0.310 |
| ⑥ | 1.333 | 0.2 | 3.667 | 0.733 |
| ⑦ | 0.667 | 0.1 | 3 | 0.3 |
| ⑧ | 0.667 | 0.067 | 4.333 | 0.29 |
| ⑨ | 0.833 | 0.083 | 1.556 | 0.129 |
| ⑩ | 20 | 2.0 | 3.667 | 7.333 |
| ⑪ | 4.694 | 0.469 | 4.222 | 1.980 |
| | | 3.6K | | 11.59 |

$$\text{F.S. against overturning about Ⓐ} = \frac{11.59 + \overset{(V)}{1.23}\,(5.667)}{\underset{(H)}{2.15}\,(2.611)} = 3.31 > 2.0 \text{ okay}$$

① through ⑦ = Concrete at 150 PCF

⑧ through ⑪ = Backfill at 100 PCF $$\text{Friction resistance to sliding} = 0.55(\overset{(V)}{3.6 + 1.23}) = 2.66\text{K}$$

$$\text{Passive Soil Pressure} = 1/2(0.4(2)^2 = 0.8\text{K}$$

$$\text{F.S. against sliding} = \frac{2.66 + 0.8}{2.15} = 1.61 > 1.5 \text{ okay}$$

Net Moment About Ⓐ = 11.59 + 1.23(5.667) − 2.15(2.611) = 12.95 FT-KIPS
Vertical = 3.6 + 1.23 = 4.83K applied 0.152' left of center of base $$\text{Soil Pressure} = \frac{4.83}{5.667} \pm \frac{0.152(4.83)}{(5.667)2/6} = \underset{\text{(left to right)}}{0.989 \text{ KSF OR } 0.715 \text{ KSF}}$$

Precast Groin

Figure 35:
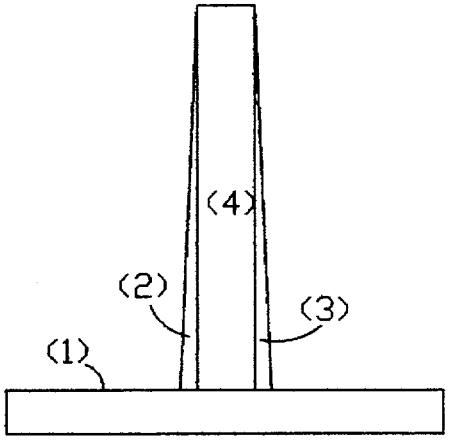

The following calculations are based on FIG. 35, with the weight of concrete under water=150 pcf

| |
|---|
| −62.4 ($H_2O$) |
| 87.6 pcf* |

*(buoyant unit weight of concrete)

The circled numerals refer to sections of the groin, as shown in FIG. 35.

| | AREA | WEIGHT | HORIZ. DIST. FROM Â | HORIZ. DIST. X WEIGHT |
|---|---|---|---|---|
| 1̂ | 0.729 | 0.0639 | 1.25 | 0.0799 |
| 2̂ | 0.023 | 0.002 | 1.097 | 0.00219 |
| 3̂ | 0.023 | 0.002 | 1.403 | 0.00281 |
| 4̂ | 0.644 | 0.0564 | 1.25 | 0.0705 |
| | | 0.1243 KIPS PER LIN. FT. | | 0.1554 FT-KIPS PER LIN. FT. |

Precast Groin Cont.

Pressure required to overturn precast groin about point Ⓐ=49.7 PSF $$\frac{\text{Pressure}\,(2.5)^2}{2} = 0.1554$$

Pressure = 0.0497 KSF
= 49.7 PSF

Stream-flow pressure is given by formula $$P = 4/3\ V^2$$

(PSF) (FT/SEC)

From Standard Handbook For Civil Engineers 2nd Edition by Merritt comes from AASHTO for Pier Erosion Thus $49.7 = 4/3\ V^2$ Water velocity required to turn groin over* { V = 6.1 FT/SEC; V = 4.16 MPH (*Can be increased by driving rods into bottom but pullout resistance of rod is unknown.)

Using coefficient of friction = 0.55

$$\text{pressure required to slide groin} = \frac{0.1243(0.55)}{2.5} = 0.027\ \text{KSF} = 27.3\ \text{PSF}$$

Lateral resistance of (4) #11 rebars × 3' driven into bottom $$\text{per 10' section is about } 4(0.4)(1/2)(3)^2\frac{(13/8)}{12} = 0.825\text{K}$$

or about 0.0825 KIP/FT (of groin)

$$\text{Then pressure required to slide} = \frac{0.1243(0.55) + 0.0825}{2.5} = 0.0603\ \text{KSF} = 60.3\ \text{PSF}$$

Precast Groin Cont.

Figure 36:
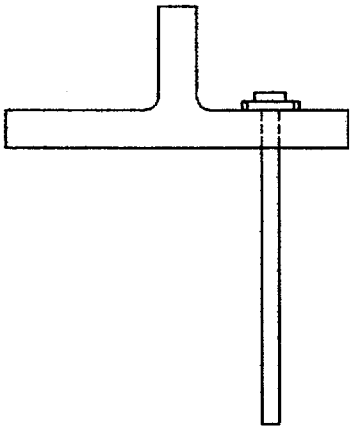
Figure 37:
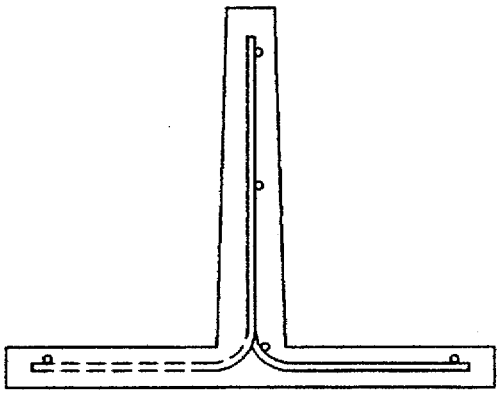

Using FIG. 36, Check Moment in #11 rebar cantilevering from underside groin into soil.

$M = 0.20625(2) = 0.4425$ FT-KIPS
$\int = 0.785398(0.6875)^3 = 0.255$
$fb = \frac{0.4125(12)}{0.255} = 19.41$ KSI <0.75(60)* *Fy
<45 KSI okay Lateral force on stake (58):

$$(3)\ 0.4\ \frac{(1\ 3/8)}{12} = 0.1375\ \text{KIPS/FT}$$

*Resultant force = 0.20625 KIPS lateral load capacity per rebar stake; thus, using 3 ft. stakes, $$\frac{4(0.20625)}{10} = 0.0825\ \text{KIPS/FT of groin}$$

Total resistance to sliding = 0.0825 + 0.55(0.1243)
= 0.1509 KIPS/FT (of groin)

Pressure on 2'6" tall groin to slide LT $$= \frac{0.1509}{2.5} = 0.0603\ \text{KSF} = 60.3\ \text{PSF}$$

Precast Groin
Conclusions Regarding Overturning/Sliding

Groin will overturn before it slides.
Water velocity required to turn it over = 6.1 FT/SEC or 4.16 MPH
This assumes no tiedown help from #11 rebar stakes driven into bottom.
Their uplift resistance according to AASHTO is 40% of vertical downward capacity which is a fraction of effort required to drive it. Since each rebar stake can accept lateral load of about 0.2 KIPS, it would be reasonable to assume uplift resistance of 0.55 (0.2) = 0.11K = 110 lb.

(Friction)

This would make overturning moment resistance =

$$\frac{0.11(2)(2)}{10} + 0.1554 = 0.1994\ \text{FT-KIPS/FT}$$

$$\text{Then required pressure to overturn} = \frac{0.1994(2)}{(2.5)} =$$

0.0638 KSF = 63.8 PSF
Utilize rebar stake uplift resistance
Then velocity of water required to overturn is
= 6.92 FT/SEC
= 4.72 MPH
{ assuming rebar stake uplift resistance = 110 lb.

Note that even if groin turns over it cannot float away.
Higher velocities may be justified based on force required to drive rebar stakes.

CHECK REBAR IN GROIN SHOWN IN FIG. 37

Moment Capacity of Stem $a = \frac{0.110(60)}{0.85(3)(18)} = 0.144''$ $$= 0.9\ \frac{\left(2 - \frac{0.144}{(2)}\right)\frac{(0.110)}{(1.5)}(60)}{12} = 0.636\ \text{FT-KIPS/FT}$$

(Ø) (#3 rebar @ 18")

Stem Covers Resistance Pressure = 155 PSF > 63.8 PSF okay.

$$\frac{p(2.2)^2}{2} *(1.7) = 0.636 \qquad \text{Pmax} = 0.155\ \text{KSF} = 155\ \text{PSF}$$

*(Load Factor)

Check Toe Moment
If put entire weight = 0.1243K @ toe
then
M = 0.1243(1.25) = 0.155 FT-KIPS/FT
Mu = 1.7(0.155) = 0.264 FT-KIPS/FT
#3 rebar @ 36" good for $$(0.9)\frac{\left(1.75 - \frac{0.072}{2}\right)\left(\frac{0.110}{3}\right)(60)}{12} = 0.283\ \text{FT-KIPS/FT} > 0.264\ \text{okay}$$

We claim:

1. A sea wall or bulkhead comprising a plurality of precast structural L-members having the shape of a modified letter "L", comprising a vertical wall portion, a horizontal footer, a vertical key protruding below the footer and an angular splash plate protruding from said wall directly opposite the footer, said L-members being connected end-to-end by connecting means, said vertical keys being set into the beach, with said horizontal footers buried in a bank or bluff to be retained and said angular splash plates extending seaward and being seated sufficiently deep in the beach adjacent the wall to resist scour and erosion under the wall.

2. The seawall of claim 1 wherein said angular splash plates are covered with a protective layer of rocks to resist scour.

3. A shoreline reinforcement system comprising a seawall in accordance with claim 1 and a plurality of groin members attached approximately perpendicular thereto and extending seaward therefrom to control erosion.

4. A shoreline reinforcement system to control erosion comprising a seawall comprising a plurality of structural precast L-members having the shape of a modified letter "L", comprising a vertical wall portion, a horizontal footer, a vertical key protruding below the footer and an angular splash plate protruding from said wall directly opposite the footer, said L-members being connected end-to-end by connecting means, with said vertical keys being set into the beach, said horizontal footers buried in a bank or bluff to be retained and said angular splash plates extending seaward, further comprising a plurality of groin members attached by connecting means approximately perpendicular to said L-members and extending seaward therefrom, wherein said groin members comprise pluralities of inverted precast "T" members, each T member having a vertical wall portion and a symmetric horizontal footer, being fastened end-to-end with connecting means, the horizontal portions of said T members being fastened to the beach with fastening means.

5. The shoreline reinforcement system of claim 4 wherein the inverted "T" members adjacent to said seawall are interlocked by interlocking means with the L-members so that the footers of said T-members are partially covered by the splash plates of said L-members.

6. A shoreline reinforcement system comprising a sea wall comprising a plurality of structural precast L-members having the shape of a modified letter "L", comprising a vertical wall portion, a horizontal footer, a vertical key protruding below the footer and an angular splash plate protruding from said wall directly opposite the footer, said L-members being connected end-to-end by connecting means, with said vertical keys being set into the beach, said horizontal footers buried in a bank or bluff to be retained and said angular splash plates extending seaward, further comprising a plurality of groin members attached by connecting means approximately perpendicular to said L-members and extending seaward therefrom, and further comprising sections of flexible concrete mat which comprise pluralities of rectangular concrete bodies interconnected with connecting means and cover at least one of a portion of the bank above said seawall and the beach below said seawall.

7. The shoreline reinforcement system of claim 6 wherein at least a portion of the concrete mat sections serve as foundations for sand dunes by underlying said dunes.

8. The shoreline reinforcement system of claim 6 wherein said concrete bodies are approximately square in shape and are interconnected on all four sides with connecting means.

9. The shoreline reinforcement system of claim 6 wherein said concrete bodies have the proportions of railroad ties and are interconnected only between their sides.

10. The shoreline reinforcement system of claim 9 wherein a second layer of said concrete mat is installed atop or alongside the first in an inverted position such that said concrete bodies of the two layers interlock.

11. A shoreline reinforcement system comprising a seawall comprising a plurality of structural precast L-members having the shape of a modified letter "L", comprising a vertical wall portion, a horizontal footer, a vertical key protruding below the footer and an angular splash plate protruding from said wall directly opposite the footer, said L-members being connected end-to-end by connecting means, with said vertical keys being set into the beach, said horizontal footers buried in a bank or bluff to be retained and said angular splash plates extending seaward, further comprising a plurality of groin members attached by connecting means approximately perpendicular thereto and extending seaward therefrom, which further comprises a pier structure attached approximately perpendicular to said seawall.

12. The shoreline reinforcement system of claim 11 wherein the foundation of said pier structure comprises inverted precast "Double-T" structures having two upright sections and a horizontal base portion.

13. The shoreline reinforcement system of claim 4, further comprising at least one row of inverted precast "T" members, each "T" member having a vertical wall portion and a symmetric horizontal footer, said members being fastened end-to-end with connecting means and arranged approximately parallel to said seawall and lying seaward therefrom, also lying seaward of said groin members.

14. The shoreline reinforcement system of claim 4 wherein the upper seaward corner of the endmost seaward "T" member of each of said groins is bevelled to prevent damage to boats in their vicinity.

15. The shoreline reinforcement system of claim 11 wherein the foundation of said pier structure comprises inverted "T" members.

16. The shoreline reinforcement system claim 11 wherein the foundation of said pier structure comprises concrete boxes.

17. The shoreline reinforcement system of claim 9 wherein a second layer of said concrete mat is installed alongside the first in an inverted and partially overlapping position such that said concrete bodies of the two layers of mat interlock.

18. The sea wall of claim 1 wherein said angular splash plate extends below the lowest level of said key.

* * * * *